United States Patent [19]

Berzin et al.

[11] 3,943,505

[45] Mar. 9, 1976

[54] AUTOMATIC INFORMATION SYSTEM FOR THE ORGANIZATION OF GYMNASTIC COMPETITIONS

[76] Inventors: Albert Yazepovich Berzin, ulitsa Vaidavas, 2/5, kv. 39; Solomon Leibovich Buslovich, ulitsa Lokomotivnaya, 84, kv. 39; Gunar Yanovich Bush, ulitsa Tsaunes, 8a, kv. 9, all of Riga; Gennady Khaimovich Gershanov, Frunzensky val, 38, kv. 79, Moscow; Aivar Alfredovich Zhagars, ulitsa Lokomotivas, 88, kv. 87, Riga; Viktor Ivanovich Kalognomos, ulitsa Stankevicha, 9, kv. 3, Moscow; Georgy Kondratievich Sokolov, ulitsa Merkolya, 9, kv. 4, Riga; Jury Konstantinovich Chervinsky, ulitsa L. Paegles, 12, kv. 8, Riga; Zigmund Yazepovich Yakovich, ulitsa Lenina, 142, kv. 17, Riga, all of U.S.S.R.

[22] Filed: Feb. 24, 1975

[21] Appl. No.: 552,068

[52] U.S. Cl...... 340/323 R; 235/92 EA; 273/1 ES; 340/337

[51] Int. Cl.[2]..... G08B 5/36

[58] Field of Search..... 340/323, 337; 273/1 ES

[56] References Cited

UNITED STATES PATENTS

| | | | |
|---|---|---|---|
| 1,922,517 | 8/1933 | Amory | 340/323 |
| 2,669,389 | 2/1954 | Mesi et al. | 340/323 X |
| 3,727,213 | 4/1973 | Kurtenbach | 340/323 |
| 3,737,889 | 6/1973 | Sweeny | 340/323 |

*Primary Examiner*—David L. Trafton
*Attorney, Agent, or Firm*—Steinberg & Blake

[57] ABSTRACT

An automatic information system applicable in the organization of gymnastic competitions is intended to collect and process the individual scores awarded by the judges to each competitor, to facilitate and accelerate the judging procedure, to keep the record and score, as well as to provide for visual display of the current and final results of a competition for the benefit of the competitors, judges and spectators. The system incorporates specialized digital devices for each event of an all-around competition, as well as superior judge's and dispatcher's panels.

8 Claims, 14 Drawing Figures

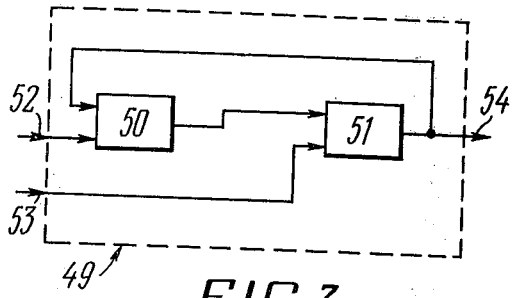
FIG. 3
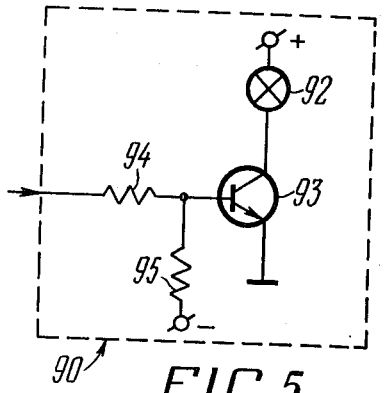
FIG. 5
FIG. 10
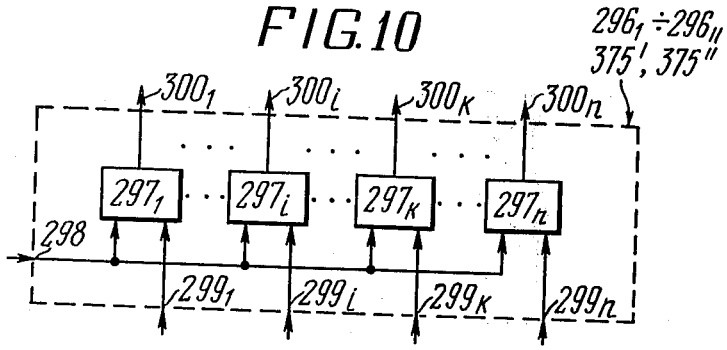

AUTOMATIC INFORMATION SYSTEM FOR THE ORGANIZATION OF GYMNASTIC COMPETITIONS

The present invention relates to digital information systems for collecting and processing digital information, and more particularly to an automatic information system for the organization of gymnastic competitions.

From the point of view of organization, a gymnastic competition can be divided into two parts: execution of exercises by the competitors and evaluation of their performance by the judges.

Officiating at a gymnastic competition is a complicated procedure. The difficulties involved in officiating or judging residue mainly in that a judge should, without the aid of any instrumentation, alone, guided only by the code of points, his knowledge and experience as to the techniques of execution of gymnastic exercises and his own concept of perfect execution of both individual elements and the combination as a whole, evaluate the performance of a competitor within a maximum of 10 points with an accuracy of 0.1 point. To minimize the factor of subjectiveness in the evaluation of an exercise as executed by a competitor, the organization of judges has been so formed that for each apparatus four or five judges are under the supervision of a superior judge, and the final score is calculated from the average scores awarded to the competitor by all judges. Thus, the final score is made as objective as possible. As an exercise is being executed by a competitor, a judge mentally compares the impression he gets from the performance with his own concept of a perfect execution of the same exercise, taking notice of every single deviation from the ideal execution, determining the seriousness of each fault and the amount of deduction to be made. At the same time, the judge should determine the difficulty of each element of the exercise, which may vary depending on the combination in which a particular part of the exercise is executed, as well as to determine compositional faults, i.e. seeing whether a competitor has executed all the parts of an exercise as required by the rules of the competition and has not violated these rules, paying special attention to the construction of the exercise, and, if necessary, deducting additional points for compositional faults.

Judges officiating at gymnastic competitions have no instruments at their disposal that would permit accurate detection of faults in the execution of an exercise by a competitor a stop watch and a measuring tape playing but a minor role and practically not affecting the final score of the competitor.

It should also be noted that a judge must give his mark, with an accuracy of 0.1 point, immediately after a competitor has completed his exercise, that exercises follow one another with 1–2 min intervals, and that the judge is supposed to remain at his apparatus for hours on end. In addition to thorough knowledge of the judging regulations (code of points) and the ability to correctly evaluate an exercise, the judge must also possess extremely high physical endurance.

For a mark to be as accurate as possible, judges should be relieved of all functions which do not demand high qualification.

More often than not attempts to facilitate the work of a judge boil down to increasing the number of judges in a jury, appointing additional judges to take over some of the functions (seeing whether a competitor steps out of the floor exercise area, starting stop watches, registering the point at which a competitor touches the horse while performing a long horse vault (grip judges), as well as appointing a second superior judge for determining the difficulty and composition of voluntary exercises when officiating in the finals. Special contrivances are also known, such as hand adders with the aid of which a judge need not memorize the points any more and mentally summarize 1/10 points deducted for faults in execution: this is done by the adder itself, which throws a 1/10 point each time the judge presses the arm of the adder. Such adders do help to add up deductions for faults. however, when it comes to determining the difficulty of an exercise, which is the most difficult part of judging, they become useless.

The superior judge has the most difficult task since, in addition to awarding his own score to a competitor, he also has to oversee his four judges and average the final score for each exercise on his apparatus. To obtain the average of the scores of his judges, he must receive from each judge his score-card with the mark the judge has awarded to the competitor (the score-card is the primary official document). Immediately after the competitor has completed an exercise, specially assigned persons deliver the score-cards to the superior judge, this primitive method causing considerable delays in the progress of the competition.

In the Soviet Union, a special system was developed designed as an aid in judging at gymnastic meets, by means of which scores were transmitted from individual judges to the superior judge and from the latter to the master judge of the competition.

This system included judges', superior judge's and master judge's panels, luminous display devices, stop watches for beam and floor exercises, and a master judge's control panel. As the judges pressed respective buttons on their panels, the scores they awarded to competitors appeared on the displays of the superior judge's and master judge's panels. The system also incorporated electric score-boards to inform the competitors and spectators on the progress in each event. The score-boards were controlled manually and were not linked with the judges' panels.

Use was also made in the above system of electric stop watches with display boards.

Visual automatic transmission of scores from the judges to the superior judge substantially accelerated the judging process, but failed to completely dispense with the delivery of score-cards from the judges to the superior judge by specially assigned persons for further confirmation of the scores awarded to each competitor.

Calculating the average and final scores involves a number of arithmetic operations, which take much of the superior judge's time and attention and keep him busy while the rest of the judges may take a short rest. To get the average score, out of the four scores awarded by the judges the highest and lowest ones are discarded and the arithmetic mean is derived from the remaining two, which serves as the final score.

In all events of the all-around, according to the rules of the competition, exercises should be executed within prescribed limits, and in long horse vaults the hands of the gymnast should touch the horse in a prescribed grip zone. Additional requirements are imposed on the beam and floor exercises as well long horse vaults as to the duration of the exercise.

If in floor exercises, beam exercises and long horse vaults the competitor violates the rules of the competition by stepping out of the floor exercise area, exceeding the prescribed time limit or touching the horse in the wrong grip zone, the superior judge deducts a respective number of points from the average score, and the resulting score is considered final.

All the judges scores, the average and final ones, are entered by the superior judge in a special record. The superior judge also calls the competitors, permits or forbids each competitor to start the exercise, registers the duration of an interruption through falling from an apparatus, signals to flash the final score, and, if necessary, calls the jury for consulation and an eventual change of the mark awarded to a competitor by one or several judges.

Thus, the superior judge has to do a lot of tedious and purely technical work which does not demand high qualification and distracts him from his main task.

Also known in the art is a system of judging aids used at World championships and Olympic Games, comprising judges' panels, a superior judge's panel, luminous display devices and, for two events, namely, beam and floor exercises, a stop watch for determining the duration of an exercise as performed by a competitor and the amount of points to be deducted, the system also comprising an inter-face connected to a computer.

The computer is associated with a luminous score board, and is connected to a printer. Information from the superior judge's panel is fed manually into the computer through the interface.

In this prior art system, the score is set by each judge on his panel and automatically transmitted to the superior judge's panel. The superior judge calculates the average score from the scores appearing on the displays of his panel. After the superior judge receives the score-cards from his judges, he checks the average score he has calculated against the score-cards.

The judges and timers (judges working with the stop watch), officiating at floor exercises, or the timers alone, in beam exercises, inform the judge of a fault in the execution for the latter to make a respective deduction and enter it in the record. The final score is manually transmitted to the luminous score board of a particular event. The final score is also manually fed into the computer through the interface. The computer processes all the scores and sends the final results to the score board and printer.

In this system, even the simplest operations by the judges and superior judge have not been automated, for example, to facilitate the calculation of the average score the only provision made was special blinds on the superior judge's panel with which the superior judge's secretary covered the highest and lowest scores.

Tine measurements in floor and beam exercises are made by timers who inform the superior judge on the time spent by the competitor executing an exercise; stepping out of the floor exercise area is registered by the on-line judges.

The recorded results in each event of an all-around competition are sent to scorers who add up the marks to obtain final individual and team scores.

The processed results are them sent to the score boards and printers for the benefit of the competitors, spectators and representatives of the press. At the Munich Olympic Games, computers were used for this purpose: an operator sitting near the superior judge sent all the necessary information to the computer center through the interface. In the computer centre, all the final scores were computed, and the teams and individual competitors were arranged in the order of the places they won. The final scores appeared on the main score board in the gymnasium and were sent to printers for the printing of bulletins and score sheets. During the competitions, however, numerous delays were taking place, as a result of which the International Gymnastics Federation (FIG) decided that in future all the results produced by the computer would be reproduced and the final scores would be calculated manually along with the computer.

Thus, as can be seen from the above description, all the currently existing aids to judging are basically designed to inform all those present at a competition rather than to automate the judging and organizational procedures. Since the required information is sent to the computer not directly from the judges' panels and not automatically, but through the operator sitting near the superior judge, errors are likely to appear in the primary information being fed into the computer. The computer being remote from the gymnasium does not allow the press corps to be informed as promptly as may be desired. Full automation of certain phases of judging is further hampered by imperfections in the judging regulations (code of points), which is especially true in the case of a competitor stepping out of the floor exercise area and accurately penalizing the competitor for this fault.

Other disadvantages of this system reside in the necessity to deliver score-cards from individual judges to the superior judge by specially assigned persons who sometimes have to cover a distance from 5 to 25 m to have the score-cards delivered as well as in the necessity to mentally calculate the average and final scores and manually keeping the record and score, transmitting the final score to the score board, starting stop watches, informing the superior judge on stepping out of the floor exercise area, and feeding the initial information into the computer. When scores are rewritten a number of times and repeatedly delivered by different persons from one judge to another, errors are apt to occur.

Therefore, a demand has arisen for an automatic system for the organization of and officiating at gymnastic competitions, permitting all the information gathered from the judges, timers and spotters of stepping out of the floor exercise area to be automatically fed into a computer placed directly in the gymnasium.

Such an automatic system should provide for all records and scores to be kept without the participation of the judging personnel and automatic transmission of the results to score boards and printers. The automatic system should also provide for efficient running of the competition as a whole and perfect organization of the judging process.

Accordingly, it is an object of the present invention to provide an automatic information system for the organization of gymnastic competitions, which will allow to dispense with manual delivery of score-cards from the judges to the superior judge, free the superior judge from the necessity to mentally calculate scores, permit automatic printing of the judges' records on a digital printer, as well as provide for automatic feeding of the required information to a luminous score board and into a computer.

With this and other objects in view, the invention resides in an automatic information system for the organization of gymnastic competitions, intended to collect and process the individual scores awarded by the judges to each competitor, to facilitate and accelerate the judging procedure, to keep the record and score, as well as to provide for visual display of the current and final results of a competition, comprising, for each event of an all-around gymnastic competition, judges' panels and a superior judge's panel intended for manual input of scores for individual exercises of a competitor, a luminous display unit for displaying the number of the competitor and the points he or she has scored, and, for two events, namely, beam and floor exercises, a stop watch for determining the duration of an exercise as performed by a competitor and the amount of points to be deducted, whereby the competitor and judges are informed as to the time the competitor has spent so far and deductions are automatically made for exceeding the prescribed time limit, and an interface intended for feeding the information provided by the judges into a computer whereto the interface is connected, which computer controls a luminous score board and has its output connected to a printer, the automatic information system also comprising, according to the invention, for each event of an all-around gymnastic competition, a scorer's panel intended for the input and storage of the competitor's number and his or her final score and connected to the luminous display unit, a digital printer for printing the record and score for each competitor, a processor intended to calculate the average and final scores awarded to a competitor, to store the current information on the progress of the competition, and send it to the interface to control the judges', superior judge's and scorer's panels, luminous display unit and printer, the processor being connected to all these units and, for two events, namely, beam and floor exercises, to the stop watch, an intercommunication unit which is switched off while a competitor is executing an exercise, connected through intercommunication lines to the judges', superior judge's and panels, the judges', superior judge's and scorer's panels, processor, luminous display unit, printer and intercommunication unit, in each event of an all-around competition, plus the stop watch, in two events, namely, beam and floor exercises, making up a specialized digital device intended to collect subjective initial information on an individual competitor, to process this information, to display the score of each competitor on the luminous score board, and to keep the record and score for each competitor, each of such digital devices being connected to the interface, a master judge's panel providing for intercommunication with the judges of all events of the all-aroung competition for displaying digital information from each specialized digital device, and a dispatcher's panel through which the dispatcher calls individual competitors in all events of the all-around gymnastic competition and which is connected to all specialized digital devices and ensures intercommunication with the master judge's panel, scorers' panels and technical service posts in the gymnasium.

It is expedient that the specialized digital device additionally comprise, in one event of an all-around gymnastic competition, namely, floor exercises, two on-line judges' panels intended for the input of a deduction for stepping out of the floor exercise area, said panels being connected to the processor and intercommunication unit.

It is desirable that each judge's panel should comprise: a memory register for storing the score awarded to a competitor; a manual score input device; a coder connected to said manual score input device and to the inputs of the memory register; a first OR circuit having its inputs connected to the outputs of the coder; a second OR circuit a distributor having one of its inputs connected to the output of the first OR circuit and the outputs connected to the inputs of the second OR circuit and to the digit select inputs of the memory register; a memory register resetting means; a third OR circuit having one of its inputs connected to the output of the memory register resetting means and the other input connected to an output of the processor; a first AND circuit having one of its inputs connected to the output of the third OR circuit and the output connected to the reset input of the distributor and to the reset input of the memory register; a second AND circuit; a record-keeping unit intended for writing down the score of a competitor on a moving paper tape, the output whereof is connected to an input of the second AND circuit whose second input is connected to the output of the second OR circuit, an indication unit; a third AND circuit; a flip-flop having its first input connected to the output of the second AND circuit, the second input connected to a group of outputs of the processor, the first output connected to a group of inputs of the processor, and the second output connected to the second input of the first AND circuit and to the first input of the third AND circuit the second input whereof is connected to a group of outputs of the processor and the output is connected to the indication unit; counters for registering elements of individual parts, of exercises characterized by different degrees of difficulty, and faults in the execution of these exercises; data input units each being coupled to a respective counter a counter resetting means; a fourth AND circuit having one of its inputs connected to the counter resetting means and the other input connected to an output of the flip-flop; a fourth OR circuit having one of its inputs connected to the output of the fourth AND circuit, the second input connected to a group of outputs of the processor, and the output connected to the reset inputs of the counters; a digital display unit, one group of inputs whereof is connected to the outputs of the counters and the other group of inputs is connected to respective outputs of the memory register, which outputs are coupled to a group of inputs of the processor; and an intercommunication assembly linked with the intercommunication unit through an intercommunication line.

It is also desirable that the superior judge's panel should comprise: memory register for storing the score awarded to a competitor; a manual score input device; a coder connected to the manual score input device and to the inputs of the memory register; a distributor intended for digitwise entry of a competitor's score in the memory register; a first OR circuit for starting the distributor, having its inputs connected to the outputs of the coder and the output connected to the input of the distributor, the outputs of the latter being connected to the digit select inputs of the memory register and to a second OR circuit; a memory register resetting means; a third OR circuit having one of its inputs connected to the output of the memory register resetting means and the other input connected to a group of outputs of the processor; a first AND circuit, one of the inputs whereof is connected to the output of the third OR circuit and the output is connected to the reset input of the distributor and to the reset input of the memory register; a second AND circuit; a record-keeping unit intended for writing down the score of a competitor on a moving paper tape, the output whereof is connected to one of the inputs of the second AND circuit whose other input is connected to the output of the second OR circuit; a flip-flop having its first input connected to the output of the second AND circuit, the second input connected to a group of outputs of the processor, the first output connected to a group of inputs of the processor, and the second output connected to the second input of the first AND circuit, counters for registering elements of individual parts of exercises, characterized by different degrees of difficulty, and faults in the execution of these exercises; data input devices each being connected to a respective counter; a counter resetting means; a third AND circuit having one of its inputs connected to the counter resetting means and the second input connected to an output of the flip-flop; a fourth OR circuit having the first input connected to the output of the third AND circuit and the second input connected to a group of outputs of the processor, while the output of the fourth OR circuit is connected to the reset inputs of the counters; a digital display unit, one group of inputs whereof is connected to the outputs of the counters, the second group of inputs is connected to respective outputs of the memory register also connected to a group of inputs of the processor, and the third group of inputs is connected to a group of outputs of the processor; a command unit having its outputs connected to a group of inputs of the processor; and an intercommunication assembly linked with the intercommunication unit through an intercommunication line.

The scorer's panel should preferably comprise: memory registers for storing, respectively, the number of a competitor and the final score awarded to the competitor for an exercise; a device for manual entry of information in the memory registers; a coder connected to the information input device and to the inputs of the memory registers; a distributor intended for digitwise entry of information in the memory registers; a first OR circuit for starting the distributor, having its inputs connected to the outputs of the coder and the output connected to the input of the distributor, the outputs of the latter being connected to the digit select inputs of the memory registers; a command unit intended for the selection of a respective memory register for data input and for controlling the luminous display unit, the first and second outputs of the command unit being connected to the data entry permit inputs of a respective memory register; a first and a second AND circuits having their first inputs interconnected and coupled to the third output of the command unit, the second inputs being connected to the first and second outputs of the command unit, respectively, the output of the first AND circuit being connected to the group of inputs of the luminous display unit, and the output of the second AND circuit being connected to an input of the processor; a memory register resetting means; a third and a fourth AND circuits having their first inputs interconnected and coupled to the memory register resetting means, the second inputs being connected to the first and second outputs, respectively, of the command unit; a second and a third OR circuits having their first inputs connected to the outputs of the third and fourth AND circuits, respectively and the outputs connected to the reset inputs of respective memory registers; a flip-flop for selecting the colour of the information being displayed on the luminous display unit; a fourth OR circuit having one of its inputs connected to the output of the resetting means, the second input interconnected with the second inputs of the second and third OR circuits and coupled to a group of outputs of the processor, the third input connected to a group of outputs of the processor and the output connected to the reset input of the distributor and to the group of inputs of the luminous display unit; a fifth OR circuit having its first input connected to the output of the fourth OR circuit, the second input connected to the fourth output of the command unit and the output connected to the second input of the flip-flop which has its first input connected to the firth output of the command unit, both outputs of the flip-flop being connected to a respective group of inputs of the luminous display unit, and the third input of the first AND circuit being interconnected with the third input of the fifth OR circuit and coupled to the group of outputs of the dispatcher's panel; a digital display unit, one group of inputs whereof is connected to a group of outputs of the processor, while the other group of inputs is connected to the outputs of the memory register intended for storing the number of a competitor, which outputs are also connected to the group of inputs of the luminous display unit and to a group of inputs of the processor, the outputs of the memory register intended for storing the final score awarded for the execution of an exercise being connected to a respective group of inputs of the processor; and an intercommunication assembly linked with the dispatchers panel through an intercommunication line.

The processor of a specialized digital device should preferably comprise; a binary counter, an adder; comparison circuits intended to compare the information from the binary counter with the information from the judges' panels and the stop watch for determining the duration of an exercise as performed by a competitor, having their first inputs interconnected digitwise and coupled to respective outputs of the binary counter and the second inputs connected to the outputs of, respectively, the judges' panels, stop watch and adder, the inputs of the latter being connected to the online judges' panels; a first distributor having its first output connected to the comparison circuit control inputs which are connected to the judges' panels, the second output connected to the control input of the comparison circuit which is connected to the stop watch and the third output connected to the control input of the comparison circuit which is connected to the adder; a first OR circuit having its inputs connected to the outputs of the comparison circuits which are connected to the judges' panels; a second distributor whose input is associated with the output of the first OR circuit; a first flip-flop and a second flip-flop the first input whereof is connected to the first output of the second distributor; a first pulse generator having its output connected to the input of the binary counter and to the count input of the first flip-flop; a first delay element having its output connected to the input of the first distributor; a second OR circuit having its output connected to the first delay element, the first input connected to the output of the comparison circuit which is connected to the stop watch and the second input connected to the output of the comparison circuit which is connected to the adder; a third flip-flop; a reversible binary counter whose control input is connected to the outputs of the third flip-flop; a memory register having its inputs connected to the outputs of the reversible binary counter, the second output of the second distributor being connected to the first input of the third flip-flop, to an input of the memory register and to the third inputs of the second OR circuit; a third OR circuit having one of its outputs connected to the input of the reversible binary counter; a first and a second AND circuits having their outputs connected to the inputs of the third OR circuit, the first inputs connected to respective outputs of the second flip-flop, the second input of the first AND circuit being connected to the output of the first pulse generator, and the second input of the second AND circuit being connected to the output of the first flip-flop; a fourth flip-flop having its output connected to the input of the first pulse generator; a second delay element whose output is connected to the first input of the fourth flip-flop; a fourth OR circuit having its output connected to the input of the second delay element and one of its inputs connected to the second output of the second distributor; a third and a fourth AND circuits whose outputs are connected to the inputs of the fourth OR circuit, the first input of the third AND circuit being connected to the first output of the first distributor, each of the remaining inputs of the third AND circuit being connected to the output of a respective judge's panel, the first input of the fourth AND circuit being connected to the third output of the first distributor, the second and third inputs of the fourth AND circuit being connected to the outputs of respective on-line judges' panels; a fifth OR circuit having one of its inputs connected to the output of the first delay element and the output connected to the second inputs of the second and fourth flip-flop, to the reset inputs of the binary counter and second distributor; a first gate unit, the inputs whereof are connected to respective outputs of the reversible binary counter; a group of OR circuits whose first inputs are connected to the outputs of the first gate unit; a second gate unit whose inputs are connected to the outputs of the memory register for storing the final score from the scorer's panel and whose outputs are connected to the second inputs of the group of OR circuits; a fifth flip-flop having its outputs connected, respectively, to the control inputs of the first and second gate units, the first input connected to the output of the comparison circuit which is coupled to the adder and to an output of the processor; a programming unit; a coder whose inputs are connected to the outputs of the programming unit; a second pulse generator; a fifth AND circuit having one of its inputs connected to the output of the second pulse generator and the output connected to the inputs of the judges' and on-line judges' panels; third gate units whose inputs are connected to the outputs of respective judges' panels and control inputs are connected to the second input of the fifth AND circuit and to a respective output of the superior judge's panel, the outputs of the first gate unit, memory register and third gate units being connected to respective units of the third group of inputs of the digital display unit of the superior judge's panel; a fourth gate unit having its inputs connected to the outputs of the superior judge's panel; a fifth gate unit having its inputs connected to the outputs of the scorer's panel; a sixth gate unit having its inputs connected to the outputs of the coder; seventh gate units having their inputs connected to the outputs of the judges' panels; an eighth gate unit having its inputs connected to the outputs of the stop watch; a ninth gate unit having its inputs connected to the outputs of the adder; a tenth gate unit having its inputs connected to the outputs of the memory register; an eleventh gate unit having its inputs connected to the outputs of the group of OR circuits; a third distributor whose outputs are connected to the control inputs of the fourth, fifth, sixth, seventh, eight, ninth, tenth and eleventh gate units, respectively; a third pulse generator whose output is connected to the input of the third distributor and to the input of the digital printer; a sixth flip-flop having its output connected to the input of the third pulse generator; a second group of OR circuits having its inputs connected to the outputs of the fourth fifth, sixth, seventh, eighth, ninth, tenth and eleventh gate units, respectively; a code converter, the inputs whereof are connected to the outputs of the second group of OR circuits and the outputs are connected to the inputs of the digital printer; a seventh and an eighth flip-flops, the first inputs whereof are connected to respective outputs of the superior judge's panel; a sixth OR circuit whose output is connected to the first input of the sixth flip-flop and to the input of the interface; a ninth flip-flop the first input whereof is connected to the output of the sixth OR circuit and the second input is connected to the output of the interface; a sixth and a seventh AND circuits having their first inputs connected to the output of the ninth flip-flop, the outputs of the seventh and eighth flip-flop being connected to the inputs of the sixth OR circuit and to the second inputs of the sixth and seventh AND circuits, and the output of the third distributor being connected to the second input of the sixth flip-flop and to the third inputs of the sixth and seventh AND circuits; a seventh OR circuit having its inputs connected to the outputs of the sixth and seventh AND circuits; a third delay element whose input is connected to the output of the seventh OR circuit and output is connected to the second input of the fifth flip-flop and to the reset inputs of the memory register, reversible binary counter and first distributor as well as to the second input of the third flip-flop, second input of the fifth OR circuit and inputs of the judges' and on-line judges' panels; a fourth delay element having its input connected to the output of the third delay element and the output connected to the reset input of the third distributor and to the second inputs of the seventh and eighth flip-flops; a fifth delay element whose input is connected to the output of the seventh AND circuit and output is connected to the inputs of the judges', on-line judges', superior judge's and scorer's panels; and an eighth OR circuit having its first input connected to the output of the superior judge's panel, the second inputs connected to the output of the scorer's panel, and the output connected to the input of the luminous display unit.

The luminous display unit should preferably comprise: a three-face luminous display board for displaying the number of a competitor and his or her final score for the execution of an exercise; power switches; a first and a second AND circuits having their first inputs connected to respective outputs of the scorer's panel, the second inputs being interconnected, and the outputs being connected to the inputs of respective power switches coupled to a power supply and having their outputs connected to the inputs of the three-face luminous display board; an OR circuit for switching on the three-face luminous diaplay board; a first and a second flip-flops for controlling the display of the number of a competitor and his ot her final score on the three-face luminous display board, the first inputs of these flip-flops being connected to respective outputs of the scorer's panel and processor, the second inputs being interconnected and coupled to the scorer's panel, and the outputs of both flip-flops being connected to the inputs of the OR circuit having its output coupled to the interconnected second inputs of the first and second AND circuits; two gate units for feeding the required information to the three-face luminous display board, having their inputs connected to the scorer's panel outputs and processor outputs, respectively, the control inputs of the first gate unit being connected to the output of the first flip-flop and the control input of the second gate unit being connected to the output of the second flip-flop; code converters for converting the information code into the code of the three-face luminous display board, the outputs of the code converters being connected to the respective inputs the three-face luminous display; groups of OR circuits having their outputs connected to the inputs of respective code converters, the first inputs of these OR circuits being connected to respective outputs of the first gate unit and the second inputs being connected to respective outputs of the second gate unit.

The proposed automatic information system for the organization of gymnastic competitions ensures accurate and fast processing of scores and provides for easy and immediate access to the records of the competition. Visual display of the scores and the possibility to see the stop watches in beam and floor exercises, as well as the presence of the control system enabling the dispatcher to call competitors to their apparatus render gymnastic competitions more interesting and pleasant to watch.

The automatic information system of the present invention substantially facilitates the organization of a competition and the judging procedure.

The invention will now be described in greater detail with reference to a preferred embodiment thereof, taken in conjunction with the accompanying drawings, wherein:

FIG. 3 is a circuit diagram of a shaper, according to the invention;

FIG. 5 is an electric circuit diagram of the indicator unit according to the invention;

FIG. 10 is a functional diagram of a gate unit, according to the invention;

Figure 1:
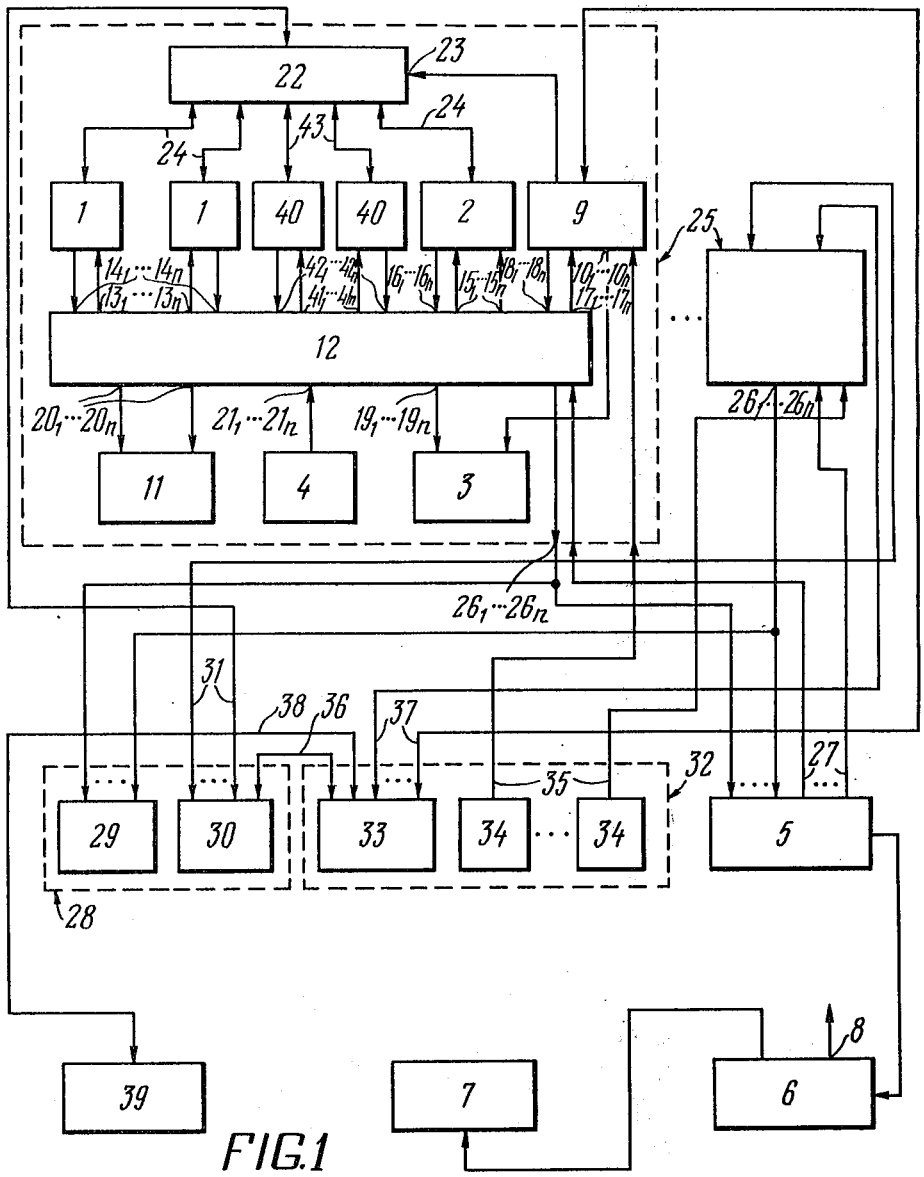
FIG. 1 is a block diagram of an automatic infromation system, according to the invention.

Referring now to the drawings, the automatic information system for the organization of gymnastic competitions comprises, for each event of an all-around gymnastic competition, judges' panels 1 (FIG. 1), a superior judge's panel 2, a luminous display unit 3 and, in two events, namely, beam and floor exercises, a stop watch 4 for determining the duration of an exercise as performed by a competitor and the amount of points to be deducted. The system also comprises an interface 5 using known circuitry and intended to feed information from the judges into an electronic computer 6, whereto it is connected, the computer 5 controlling a luminous score board 7 using known circuitry and having a printer connected to its output 8.

According to the invention, for each event of an all-around gymnastic competition, the system also includes a scorer's panel 9 having a group of inputs $\mathbf{10}_1, \ldots, \mathbf{10}_n$ connected to the inputs of the luminous display unit 3, a digital printer 11 of a known structure, a processor 12 having a group of outputs $\mathbf{13}_1, \ldots, \mathbf{13}_n$ and a group of inputs $\mathbf{14}_1, \ldots, \mathbf{14}_n$ connected, respectively, to the inputs and outputs of the judges' panels 1, a group of outputs $\mathbf{15}_1, \ldots, \mathbf{15}_n$ and a group of inputs $\mathbf{16}_1, \ldots, \mathbf{16}_n$ connected, respectively, to the inputs and outputs of the superior judge's panel 2, a group of outputs $\mathbf{17}_1, \ldots, \mathbf{17}_n$ and a group of inputs $\mathbf{18}_1, \ldots, \mathbf{18}_n$ connected, respectively, to the inputs and outputs of the scorer's panel 9, a group of outputs $\mathbf{19}_1, \ldots, \mathbf{19}_n$ connected to the inputs of the luminous display unit 3, and a group of outputs $\mathbf{20}_1, \ldots, \mathbf{20}_n$ connected to the group of control inputs of the digital printer 11.

For two events of an all-around gymnastic competition, namely, beam and floor exercises, the processor 12 has its group of inputs $\mathbf{21}_1, \ldots, \mathbf{21}_n$ connected to the group of outputs of the stop watch 4.

For each event of an all-around gymnastic competition, the system is provided with an intercommunication unit 22 which remains switched off while a competitor is executing an exercise and has its input 23 connected to the output of the scorer's panel 9.

The judges' panel 1 and superior judge's panel 2 are linked, through intercommunication lines 24, with the intercommunication unit 22.

For each event of an all-around gymnastic competition, the judges' panels 1, superior judge's panel 2, scorer's panel 9, processor 12, luminous display unit 3, digital printer 11, intercommunication unit 22 and, for beam and floor exercises, stop watch 4 make up a specialized digital device 25.

Each specialized digital device 25 has a group of outputs $\mathbf{26}_1, \ldots, \mathbf{26}_n$ and its inputs connected, respectively, to a group of inputs and a group of outputs of the interface 5.

Provision has also been made in the system for a master judge's panel 28 actuating a digital display unit 29 using a conventional circuit and an intercommunication unit 30 also using a conventional circuit, the master judge's panel 28 is linked, through intercommunication lines 31, with the specialized digital devices 25. The panel 28 has its group of inputs connected to the group of outputs $\mathbf{26}_1, \ldots, \mathbf{26}_n$ of all the specialized digital devices 25.

The system additionally has a dispatcher's panel 32 actuating an intercommunication unit 33 using a conventional circuit and command units 34. The panel 32 has its group of outputs 35 connected to the group of inputs of all the specialized digital devices 25.

The dispatcher's panel 32 is also linked, through intercommunication lines 36, 37 and 38, with the master judge's panel 28, all scorers' panels 9 and technical service posts 39 in the gymnasium, respectively.

In accordance with the invention, the specialized digital device used in one of the events of an all-around gymnastic competition, namely, floor exercises, additionally includes two on-line judges' panels 40 having their group of inputs and group of outputs connected, respectively, to a group of outputs $41_1, \ldots, 41_n$ and a group of inputs $42_1, \ldots, 42_n$ of the processor 12.

The on-line judges' panels 40 are linked, through intercommunication lines 43, with the intercommunication unit 22.

The on-line judges' panels 40 are similar to the judges' panels 1.

Figure 2:
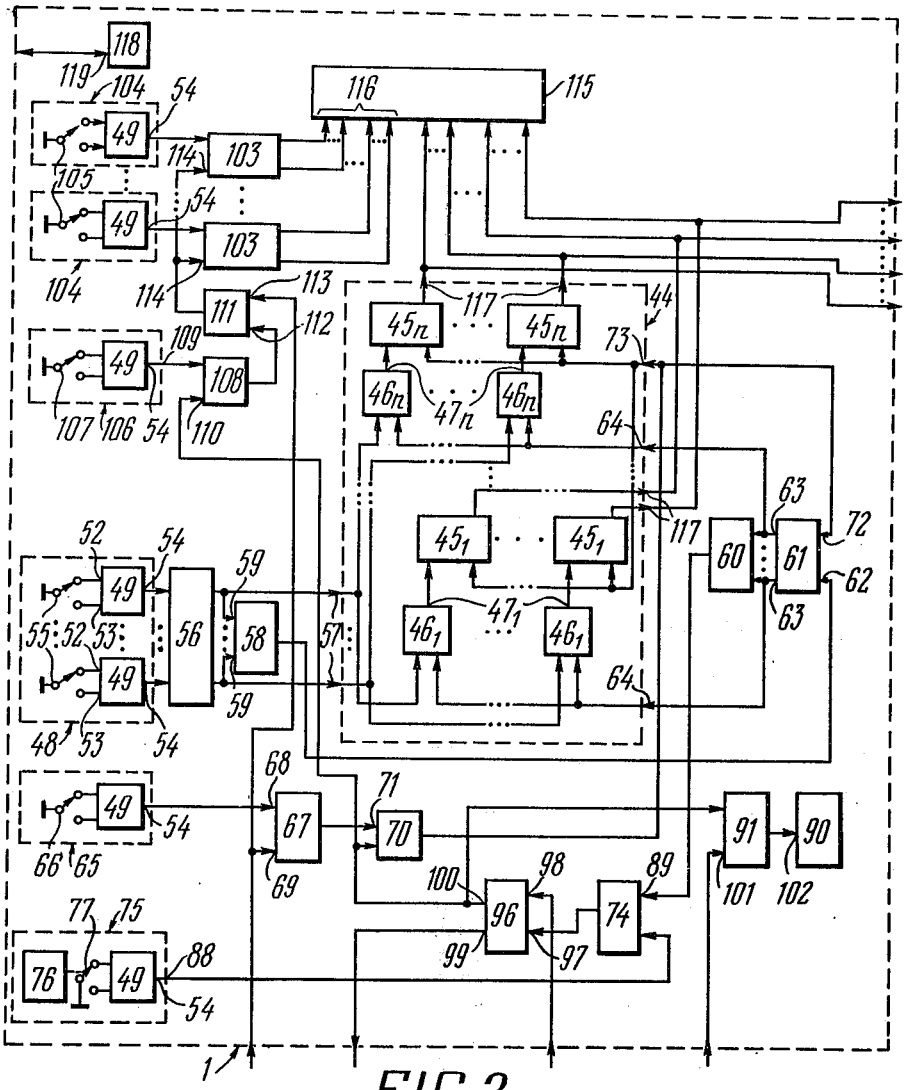
FIG. 2 is a functional diagram of a judge's panel, according to the invention.

Each judge's panel 1 (FIG. 2) comprises a memory register 44 including flip-flops $45_1, \ldots, 45_n$ as well as AND circuits $46_1, \ldots, 46_n$ having their outputs $47_1, \ldots, 47_n$ connected to the first inputs of respective flip-flops $45_1, \ldots, 45_n$ whose second inputs are interconnected.

The judge's panel 1 also comprises a score manual input device 48 including shapers 49 each having two AND-NOT circuits 50 and 51 (FIG. 3) using an RS-flip-flop whose first input coincides with an input 52 of the shaper 49 and second input coincides with an input 53 of the shaper 49, and an output 54.

The inputs 52 and 53 of each shaper 49 (FIG. 2) are connected to push-button switches 55.

Each judge's panel 1 additionally comprises a coder 56 associated with the score input device 48 and inputs 57 of the memory register 44, a first OR circuit 58 having its inputs 59 connected to the outputs of the coder 56, a second OR circuit 60, and a distributor 61 using a conventional circuit, having its input 62 connected to the output of the first OR circuit 58 and outputs 63 connected to the second OR circuit 60 and to digit select inputs 64 of the memory register 44.

In each judge's panel 1, there is also a memory register resetting means 65 including a shaper 49 with its inputs being connected to a push-button switch 66, and a third OR circuit 67 having its input 68 connected to the output of the memory register resetting means 65 and input 69 being the input of the judge's panel 1, connected to the group of outputs $13_1, \ldots, 13_n$ (FIG. 1) of the processor 12.

The judge's panel 1 (FIG. 2) also includes a first AND circuit 70 having its input 71 connected to the output of the third OR circuit 67 and the output connected to reset inputs 72 and 73 of the distributor 61 and memory register 44, respectively, the reset input 73 of the memory register 44 being coupled to the combined second inputs of the flip-flops $45_1, \ldots, 45_n$.

The judge's panel 1 further comprises a second AND circuit 74 and a record-keeping unit 75 including a mechanism 76 and a shaper 49 having its inputs connected to a limit switch 77 mechanically associated with the mechanism 76.

Figure 4:
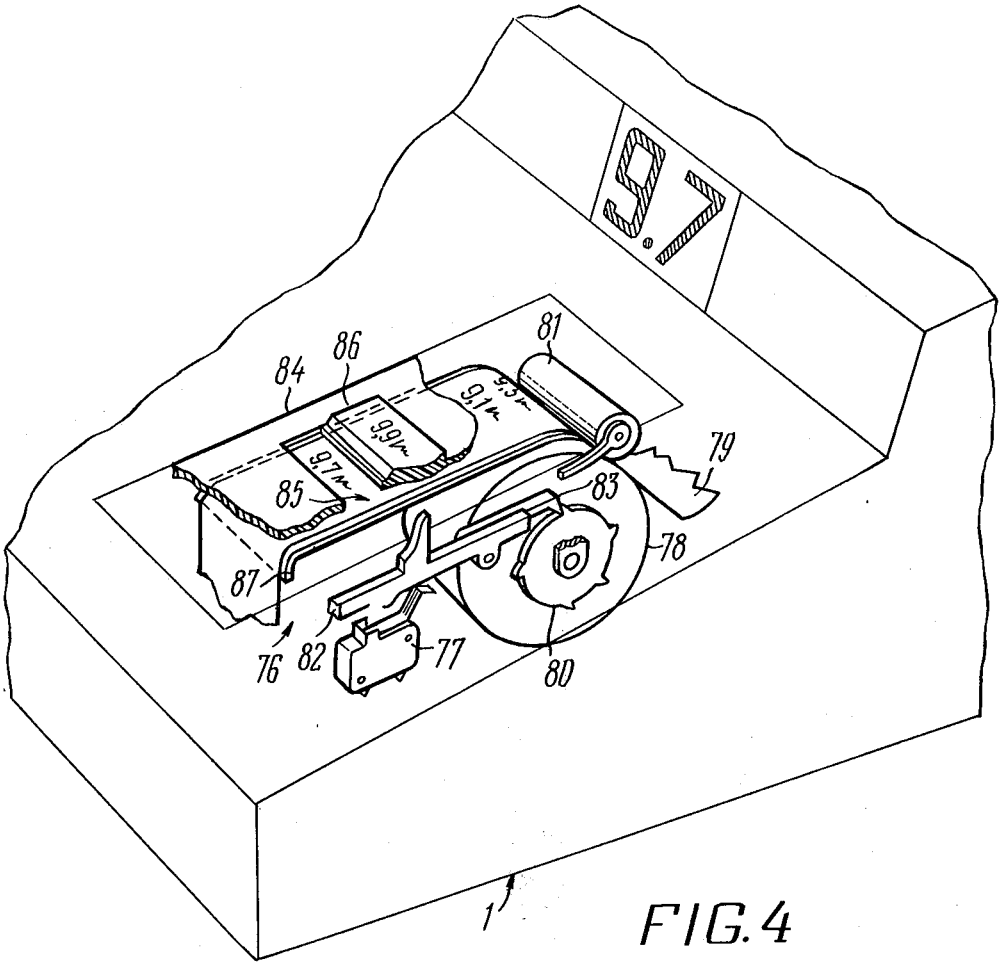
FIG. 4 is an isometric general view of the record-keeping unit mechanism, according to the invention.

The mechanism 76 (FIG. 4) comprises a driven roller 78 for feeding a paper tape 79, a ratchet 80, a pressure roller 81, an arm 82 with a pawl 83, mechanically associated with the ratchet 80 and the limit switch 77, a cover 84 with a slot 85 and a transparent plate 86, and a base 87.

An output 88 (FIG. 2) of the record-keeping unit 75 is connected to one of the inputs of the second AND circuit 74 (FIG. 2) the other input whereof is coupled to the output of the second OR circuit 60.

The judge's panel 1 is also provided with an indication unit 90 and a third AND circuit 91.

The indication unit 90 (FIG. 5) includes a signal lamp 92 and a transistor 93 the collector circuit whereof incorporates the signal lamp 92 and the base circuit includes a coupling resistor 94 and a bias resistor 95.

The judge's panel 1 (FIG. 2) also has a flip-flop 96 a first input 97 whereof is connected to the output of the second AND circuit 74 and a second input 98, serving as an input of the judge's panel 1, is coupled to a group of outputs $13_1, \ldots, 13_n$ (FIG. 1) of the processor 12.

An output 99 (FIG. 2) of the flip-flop 96, serving as the output of the judge's panel 1 (FIG. 1), is connected to the group of outputs $14_1, \ldots, 14_n$ of the processor 12, while an output 100 (FIG. 2) of the flip-flop 96 is coupled to the input of the first AND circuit 70 and to the first input of the third AND circuit 91 whose second input 101, also serving as an input of the judge's panel 1, is connected to the group of outputs $13_1, \ldots, 13_n$ (FIG. 1) of the processor 12, the output of the third AND circuit 91 (FIG. 2) being connected to an input 102 of the indication unit 90.

Other components of the judge's panel 1 include counters 103 built around known circuits and data input units 104, each being connected to a respective counter 103.

Each data input unit 104 incorporates a shaper 49 with a push-button switch 105 being connected to its inputs.

The judge's panel 1 also comprises a counter resetting means 106 including a shaper 49 having a push-button switch 107 connected to its inputs.

The judge's panel 1 further comprises a fourth AND circuit 108 whose one input is connected to an output 109 of the counter resetting means 106 and the other input 110 is connected to the output 100 of the flip-flop 96 and a fourth OR circuit 111 one input 112 whereof is connected to the output of the fourth AND circuit 108, the other input 113, serving as an input of the judge's panel 1, is connected to the group of outputs $13_1, \ldots, 13_n$ (FIG. 1) of the processor 12 and the output is connected to reset inputs 114 (FIG. 2) of the counters 103.

The judge's panel 1 additionally comprises a digital display unit 115 using a conventional circuit, one group of inputs 116 whereof is connected to the outputs of the counters 103, the other group of inputs is connected to respective outputs 117 of the memory register 44, serving as inputs of the judge's panel 1, connected to the group of inputs $14_1, \ldots, 14_n$ (FIG. 1) of the processor 12.

Finally, the judge's panel 1 (FIG. 2) comprises an intercommunication assembly 118 of a conventional arrangement, an input 119 whereof is linked, through the intercommunication line 24 (FIG. 1), with the intercommunication unit 22.

Figure 6:
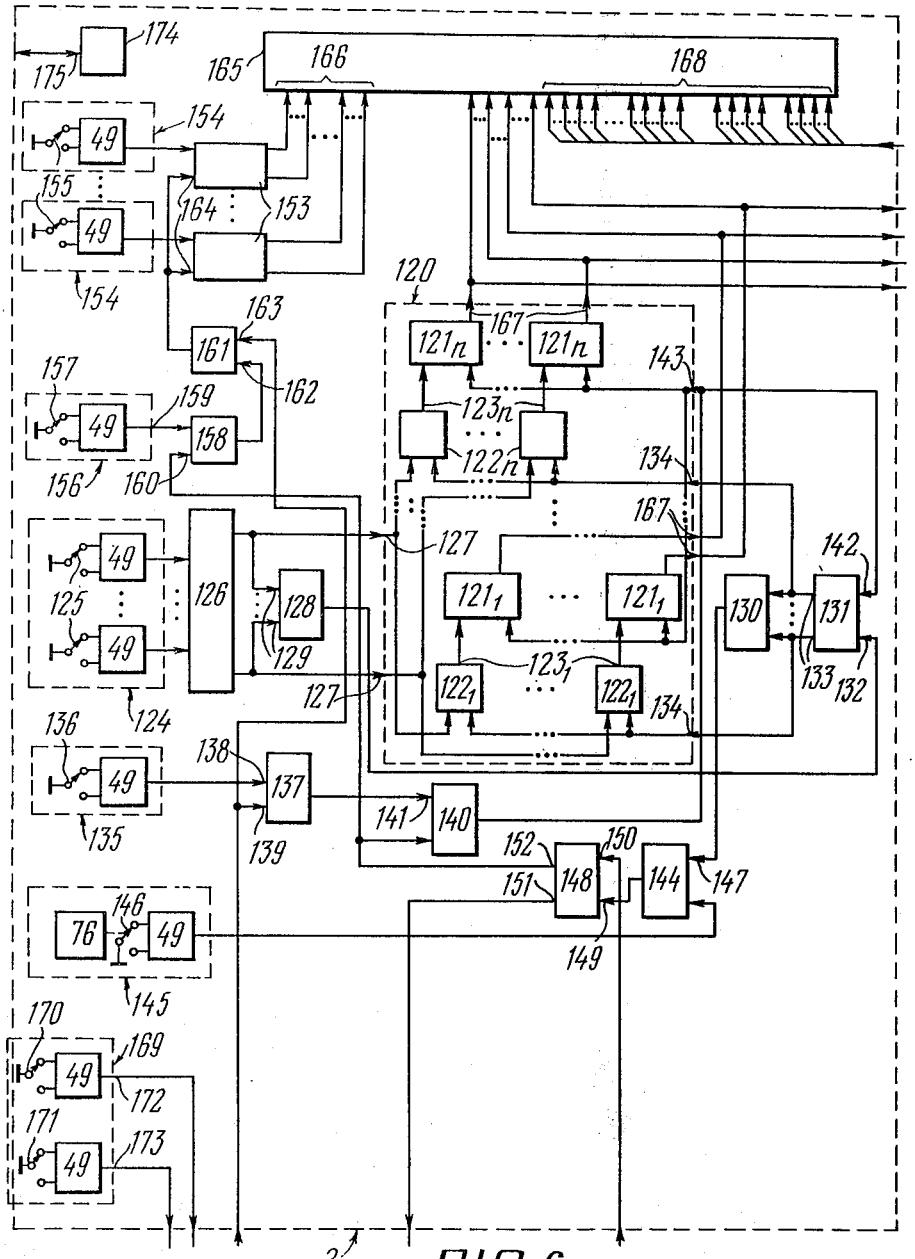
FIG. 6 is a functional diagram of the superior judge's panel, according to the invention.

According to the invention, the superior judge's panel 2 (FIG. 6) comprises a memory register 120 including flip-flops $121_1, \ldots, 121_n$ as well as AND circuits $122_1, \ldots, 122_n$ whose outputs $123_1, \ldots, 123_n$ are coupled to the first inputs of respective flip-flops $121_1, \ldots, 121_n$, their second inputs being interconnected.

The superior judge's panel 2 also comprises a manual score input device 124 including shapers 49 with push-button switches 125 connected to their inputs.

The superior judge's panel 2 further comprises a coder 126 associated with the score manual input device 124 and with inputs 127 of the memory register 120, a first OR circuit 128, inputs 129 whereof are connected to the outputs of the coder 126, a second OR circuit 130, and a distributor 131 using a conventional circuit, having an input 132 connected to the output of the first OR circuit 128 and outputs 133 connected to the second OR circuit 130 and to digit select inputs 134 of the memory register 120.

The superior judge's panel 2 additionally comprises a memory register resetting means 135 including a shaper 49 with a push-button switch 136 connected to its inputs, and a third OR circuit 137 having an input 138 connected to the output of the memory register resetting means 135 and an input 139, serving as an input of the superior judge's panel 2, connected to the group of outputs $15_1, \ldots, 15_n$ (FIG. 1) of the processor 12.

There is also provided, in the superior judge's panel 2 (FIG. 6), a first AND circuit 140 one input 141 whereof is connected to the output of the third OR circuit 137 and the output is connected to reset inputs 142 and 143 of the distributor 131 and memory register 120, respectively, the reset input 143 being coupled to the interconnected second inputs of the flip-flops $121_1, \ldots, 121_n$.

The superior judge's panel 2 also includes a second AND circuit 144 and a record-keeping unit 145 incorporating a mechanism 76 and a shaper 49 with a limit switch 146 connected to its inputs, mechanically associated with the mechanism 76. The output 55 (FIG. 3) of the shaper 49 of the unit 145 (FIG. 6) is connected to one of the inputs of the second AND circuit 144, the other input 147 whereof is connected to the output of the second OR circuit 130.

The superior judge's panel 2 further includes a flip-flop 148 having its first input 149 connected to the output of the second AND circuit 144 and a second input 150, serving as an input of the superior judge's panel 2, connected to the group of outputs $15_1, \ldots, 15_n$ (FIG. 1) of the processor 12. An output 151 of the flip-flop 148, serving as an output of the superior judge's panel 2, is associated with the group of inputs $16_1, \ldots, 16_n$ (FIG. 1) of the processor 12. An output 152 (FIG. 6) of the flip-flop 148 is connected to the input of the first AND circuit 140.

The superior judge's panel 2 additionally includes counters 153 using known circuits and input units 154, each being connected to a respective counter 153.

Each input unit 154 includes a shaper 49 with a push-button switch 155 connected to its inputs.

In the superior judge's panel 2, there is also a counter resetting means 156 including a shaper 49 with a push-button switch connected to the inputs thereof.

The superior judge's panel 2 also comprises a third AND circuit 158 having an input connected to an output 159 of the counter resetting means 156 and an input 160 connected to the output 152 of the flip-flop 148, and a fourth OR circuit 161 having an input 162 connected to the output of the third AND circuit 158 and an input 163, serving as an input of the superior judge's panel 2, connected to the group of outputs $15_1, \ldots, 15_n$ (FIG. 1) of the processor 12, the output of the fourth OR circuit 161 being coupled to reset inputs 164 (FIG. 6) of the counters 153.

Provision has also been made, in the superior judge's panel 2, for a digital display unit 165 using a conventional circuit, one group of inputs 166 whereof is associated with the outputs of the counters 153, the second group of inputs is connected to respective outputs 167 of the memory register 120, the outputs 167 serving as outputs of the superior judge's panel 2 and being connected to the group of inputs $16_1, \ldots, 16_n$ (FIG. 1) of the processor 12, and the third group of inputs 168 (FIG. 6), serving as a group of inputs of the panel 2, is connected to the group of outputs $15_1, \ldots, 15_n$ (FIG. 1) of the processor 12.

The superior judge's panel 2 (FIG. 6) also has, among its components, a command unit 169 including shapers 49 and push-button switches 170 and 171 connected, respectively, to the inputs of the shapers 49.

Outputs 172 and 173 of the command unit 169, serving as respective outputs of the superior judge's panel 2, are connected to the group of inputs $16_1, \ldots, 16_n$ (FIG. 1) of the processor 12.

And, finally, the superior judge's panel 2 (FIG. 6) comprises an intercommunication assembly 174 arranged in a conventional manner, having its input 175 linked, through the intercommunication line 24 (FIG. 1), with the intercommunication unit 22.

The scorer's panel 9 (FIG. 7) comprises, in accordance with the invention, a memory register 176 for storing the number of a competitor and a memory register 177 for storing the final score awarded to the competitor for the execution of an exercise.

The memory register 176 includes flip-flops $178_1, \ldots, 178_n$ as well as AND circuits $179_1, \ldots, 179_n$ having their outputs $180_1, \ldots, 180_n$ connected to the first inputs of the flip-flops $178_1, \ldots, 178_n$, their second inputs being interconnected.

The memory register 177 includes flip-flops $181_1, \ldots, 181_n$ as well as AND circuits $182_1, \ldots, 182_n$ having their outputs $183_1, \ldots, 183_n$ connected to the first inputs of the flip-flops $181_1, \ldots, 181_n$, their second inputs being interconnected.

The scorer's panel 9 also comprises an input device 184 including shapers 49 and push-button switches 185 connected to the inputs of the shapers 49, and a coder 186 connected to the input device 184 and to inputs 187 and 188 of the memory registers 176 and 177, respectively.

The scorer's panel 9 further comprises a distributor 189 built around a known circuit, a first OR circuit 190 having its inputs 191 connected to the outputs of the coder 186 and output 192 connected to the input of the distributor 189 whose outputs 193 are coupled to the digit select inputs of the memory registers 176 and 177, and a command unit 194 including shapers 49 and push-button switches 195, 196, 197, 198 and 199 connected to the inputs of the shapers 49, a first output 200 and a second output 201 of the command unit 194 being connected to the data entry permit inputs of respective memory registers 176 and 177.

The scorer's panel 9 additionally comprises a first AND circuit 202 and a second AND circuit 203, both having their first inputs interconnected and coupled to a third output 204 of the command unit 194, while the second inputs of the AND circuits 202 and 203 are connected to the first output 200 and second output 201, respectively, of the command unit 194. An output 205 of the first AND circuit 202, coinciding with the output $10_1$ of the group of outputs $10_1, \ldots, 10_n$ (FIG. 1) of the scorer's panel 9, is connected to an input of the group of inputs of the luminous display unit 3 (FIG. 1), while the output 206 (FIG. 7) of the second AND circuit 203, serving as an input of the scorer's panel 9, is connected to the group of inputs $18_1, \ldots, 18_n$ (FIG. 1) of the processor 12.

In the scorer's panel 9 (FIG. 7), there are also a means 207 for resetting the memory registers 176 and 177, including a shaper 49 and a push-button switch 208 connected to the inputs of the shaper 49, a third AND circuit 209 and a fourth AND circuit 210, the first inputs of these circuits being interconnected and coupled to the means 207 for resetting the memory registers 176 and 177 and the second inputs being connected to the first output 200 and second output 201, respectively, of the command unit 194.

The scorer's panel 9 also includes a second OR circuit 211 and a third OR circuit 212, whose first inputs are connected to outputs 213 and 214, respectively, of the third AND circuit 209 and fourth AND circuit 210, outputs 215 and 216 of the second and third OR circuits 211 and 212, respectively, are connected to the reset inputs of respective memory registers 176 and 177, as well as a fourth OR circuit 218 having an input 219 connected to the output of the resetting means 207, a second input interconnected with the second inputs of the second and third OR circuits 211 and 212, coinciding with an input 220 of the scorer's panel 9 and coupled to the group of outputs $17_1, \ldots, 17_n$ (FIG. 1) of the processor 12, a third input 221, serving as an input of the scorer's panel 9, connected to the group of outputs $17_1, \ldots, 17_n$ (FIG. 1) of the processor 12, and an output 222 connected to the reset input of the distributor 189 and coinciding with the group of outputs $10_1, \ldots, 10_n$ (FIG. 1) of the scorer's panel 9.

The scorer's panel 9 (FIG. 7) further includes a fifth OR circuit 223 having its first input connected to the output 222 of the fourth OR circuit 218, a second input connected to a fourth output 224 of the command unit 194, and an output 225 connected to the second input of the flip-flop 217 whose first input is coupled to a fifth output 226 of the command unit 194. Outputs 227 and 228 of the flip-flop 217 coincide with the group of outputs $10_1, \ldots, 10_n$ (FIG. 1) of the scorer's panel 9, a third output 229 (FIG. 7) of the first AND circuit 202 is interconnected with the third input of the fifth OR circuit 223, serves as an input of the scorer's panel 9 and is coupled to the group of outputs 35 (FIG. 1) of the displatcher's panel 32.

The scorer's panel 9 (FIG. 7) additionally includes a digital display unit 230 built around a conventional circuit, one group of inputs 231 whereof is associated with the group of outputs $17_1, \ldots, 17_n$ (FIG. 1) of the processor 12, the other group of inputs is associated with outputs 232 (FIG. 7) of the memory register 176, coincides with the group of outputs $10_1, \ldots, 10_n$ (FIG. 1) of the scorer's panel 9 and is coupled to the group of inputs $18_1, \ldots, 18_n$ of the processor 12, and outputs 233 (FIG. 7) of the memory register 177, serving as outputs of the scorer's panel 9, are connected to respective inputs of the group of inputs $18_1, \ldots, 18_n$ (FIG. 1) of the processor 12.

Finally, the scorer's panel 9 comprises an intercommunication assembly 234 (FIG. 7) built around a conventional circuit and linked, through the intercommunication line 35 (FIG. 1), with the dispatcher's panel 32.

Figure 8:
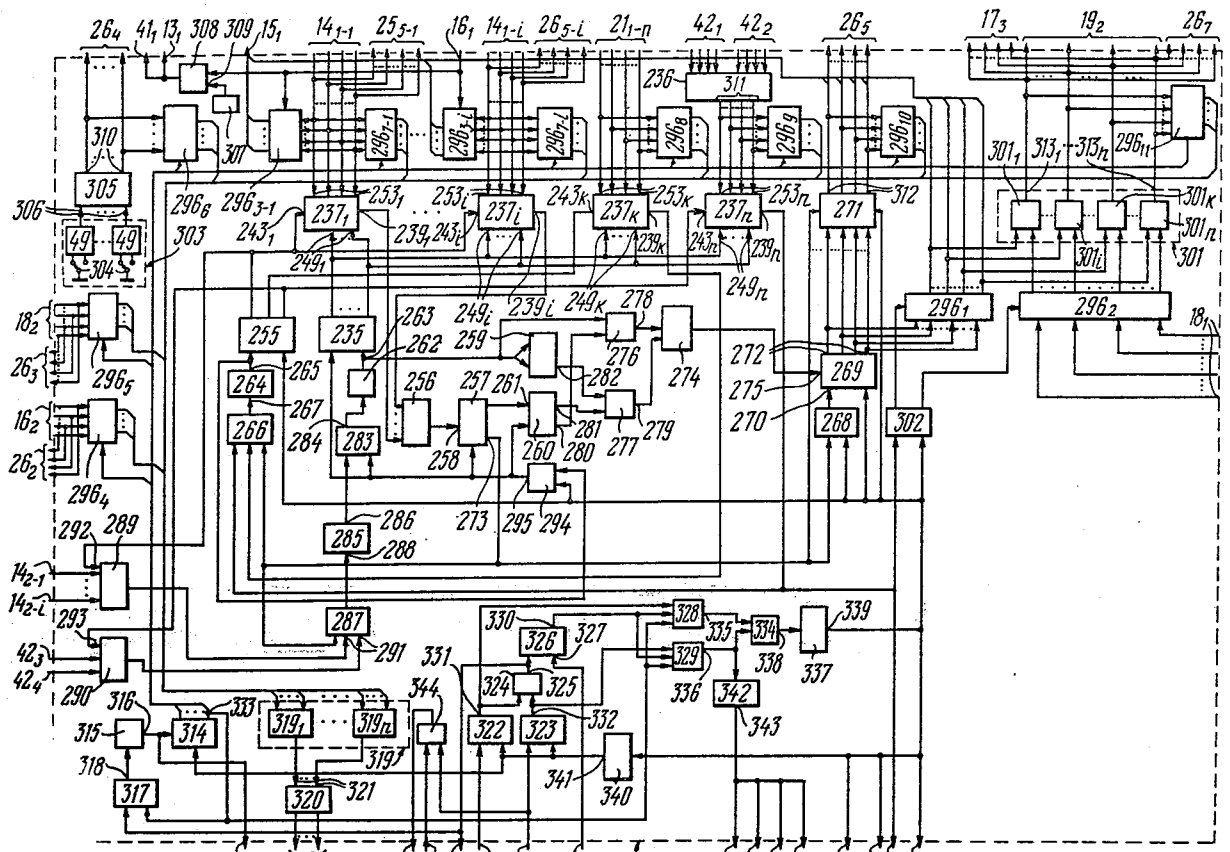
FIG. 8 is a functional diagram of the processor, according to the invention.
Figure 9:
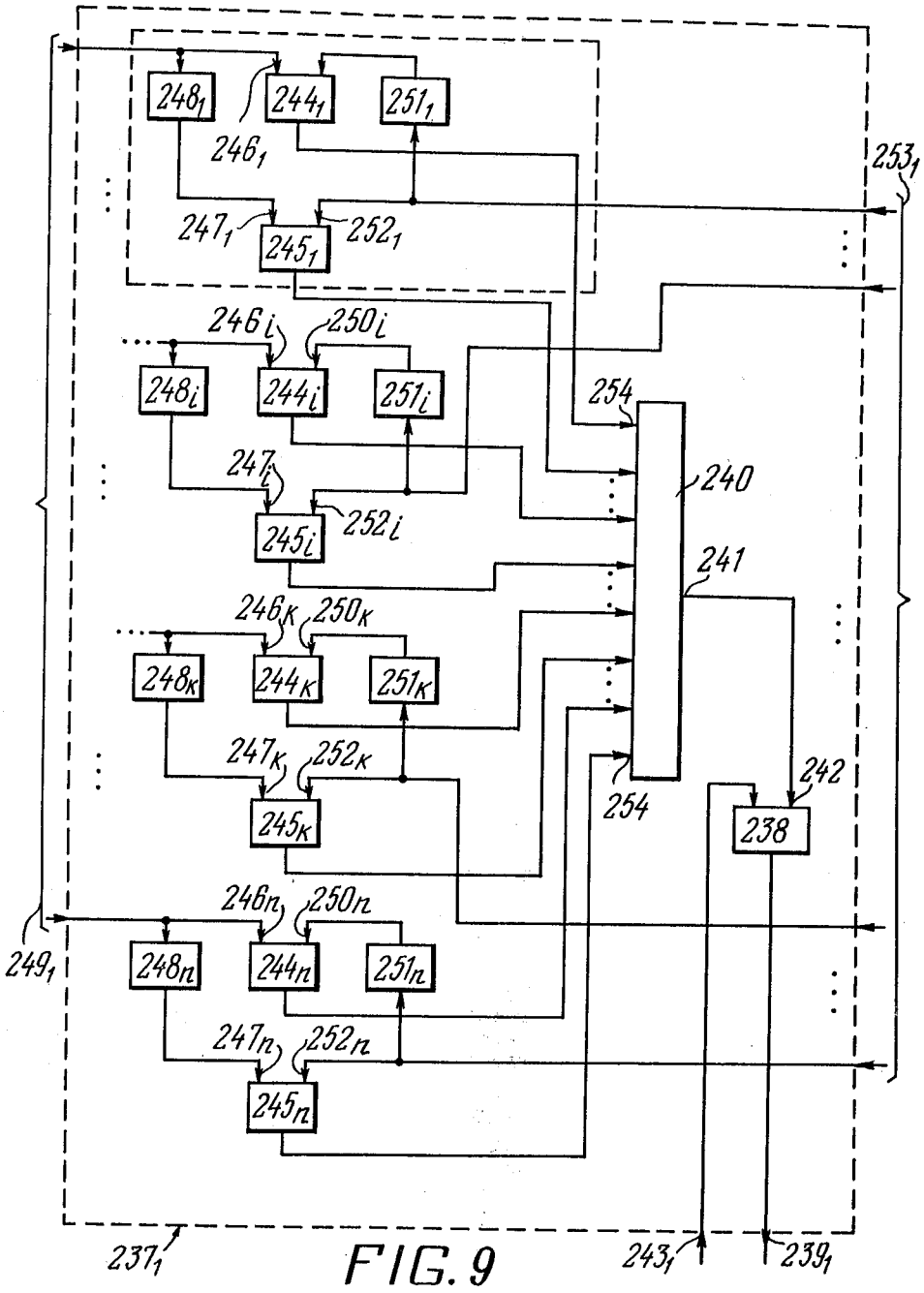
FIG. 9 is a functional diagram of a comparison circuit, according to the invention.

According to the invention, the processor 12 (FIG. 8) comprises a binary counter 235, an adder 236 using a known circuit, comparison circuits $237_1, \ldots, 237_i$, $237_k$ and $237_n$, which are intended for comparison of the information provided by the binary counter 235 with the output information from the judges' panels 1 (FIG. 1) and stop watch 4. Each of the above comparison circuits $237_1, \ldots, 237_i$, $237_k$ and $237_n$ FIG. 8) includes a first AND circuit 238 (FIG. 9) whose output is connected to one of outputs $239_1, \ldots, 239_i$, $239_k$ and $239_n$ of the comparison circuits $237_1, \ldots, 237_i$, $237_k$ and $237_n$ (FIG. 8), an OR-NOT circuit 240 (FIG. 9) whose output 241 is connected to an input 242 of the first AND circuit 238 the second input whereof is connected to one of control inputs $243_1, \ldots, 243_n$, $243_k$ and $243_n$ of the comparison circuits $237_1, \ldots, 237_i$, $237_k$ and $237_n$ (FIG. 8) which also include second AND circuits $244_1, \ldots, 244_n$ (FIG. 9) and third AND circuits $245_1, \ldots, 245_n$. First inputs $246_1 \ldots, 246_n$ of the second AND circuits $244_1, \ldots, 244_n$, directly, and first inputs $247_1, \ldots, 247_n$ of the third AND circuits $245_1, \ldots, 245_n$, through inverters $248_1, \ldots, 248_n$, are connected to one of groups of inputs $249_1, \ldots, 249_i$, $249_k$ and $249_n$ of the comparison circuits $237_1, \ldots, 237_i$, $237_k$ and $237_n$ (FIG. 8), intended for the entry of the code of the binary counter 235. Second inputs $250_1, \ldots, 250_n$ (FIG. 9) of the second AND circuits $244_1, \ldots, 244_n$, through inverters $251_1, \ldots, 251_n$, and second inputs $252_1, \ldots, 252_n$ of the third AND circuits $245_1, \ldots, 245_n$, directly, are connected to respective inputs $235_1, \ldots, 253_i$, $253_k$ and $253_n$ of the comparison circuits $237_1, \ldots, 237_i$, $237_k$ and $237_n$ (FIG. 8), intended for the entry of codes from the outputs of the judges' panels 1 (FIG. 1), stop watch 4 and adder 236 (FIG. 8). The outputs of the second AND circuits $244_1, \ldots, 244_n$ (FIG. 9) and third AND circuits $245_1, \ldots, 245_n$ are connected, respectively, to inputs 254 of the OR-NOT circuit 240. The inputs $249_1, \ldots, 249_i$, $249_k$ and $249_n$ (FIG. 8) of the circuits $237_1, \ldots, 237_i$, $237_k$ and $237_n$ are interconnected digitwise and coupled to respective outputs of the binary counter 235, the inputs $253_1, \ldots, 253_i$ of the comparison circuits $237_1, \ldots, 237_i$ coinciding with inputs $14_{1-1}, \ldots, 14_{1-i}$, respectively, of the group of inputs $14_1, \ldots, 14_n$ (FIG. 1) of the processor 12 and being coupled to the outputs 117 (FIG. 2) of the memory register 44 of a judge's panel 1 (FIG. 1). The inputs $253_k$ (FIG. 8) of the comparison circuit $237_k$ coincide with the group of inputs $21_1, \ldots, 21_n$ (FIG. 1) of the processor 12 and are coupled to the output of the stop watch 4, while the inputs $253_n$ (FIG. 8) of the comparison circuit $237_n$ are connected to the outputs of the adder 236. The inputs of the adder 236 coincide with the inputs $42_1$ and $42_2$ of the group of inputs $42_1, \ldots, 42_n$ (FIG. 1) of the processor 12 and are connected to the outputs 117 (FIG. 2) of the memory register 44 of an on-line judge's panel 40 (FIG. 1).

The processor 12 (FIG. 8) also comprises a first distributor 255 using a conventional circuit, the first output whereof is connected to the control inputs $243_1, \ldots, 243_i$ of the comparison circuits $237_1, \ldots, 237_i$, the second output is connected to the control input $243_k$ of the comparison circuit $237_k$ and the third output is connected to the control input $243_n$ of the comparison circuit $237_n$, a first OR circuit 256 having its inputs connected to the outputs $239_1, \ldots, 239_i$ of the comparison circuits $237_1, \ldots, 237_i$, a second distributor 257 also using a conventional circuit, having its input 258 connected to the output of the first OR circuit 256, a first flip-flop 259, a second flip-flop 260 whose first input 261 is connected to the first output of the second distributor 257, a first pulse generator 262 built around a conventional circuit, with its output 263 being coupled to the input of the binary counter 235 and the count input of the first flip-flop 259, a first delay element built around a known circuit, an output 265 whereof is connected to the input of the first distributor 255, and a second OR circuit 266 whose output 267 is coupled to the first delay element 264. The first input of the second OR circuit 266 is connected to the output $239_k$ of the comparison circuit $237_k$, while its second input is connected to the output $239_n$ of the comparison circuit $237_n$. The processor 12 additionally comprises a third flip-flop 268, a reversible binary counter 269 using a conventional circuit, a control input 270 whereof is connected to the outputs of the third flip-flop 268, and a memory register 271, also using a conventional circuit, having its inputs connected to outputs 272 of the reversible binary counter 269.

A second output 273 of the second distributor 257 is connected to the first input of the third flip-flop 268, to the entry permit input of the memory register 271 and to the third input of the second OR circuit 266.

The processor 12 further comprises a third OR circuit 274 whose output is connected to an input 275 of the reversible binary counter 269, a first AND circuit 276, and a second AND circuit 277. An output 278 of the AND circuit 276 and an output 279 of the AND circuit 277 are connected to the inputs of the third OR circuit 274. The first input of the first AND circuit 276 is coupled to an output 280 of the second flip-flop 260, the first input of the second AND circuit 277 is coupled to an output 281 of the second flip-flop 260, the second input of the first AND circuit 276 is coupled to the output 263 of the pulse generator 262, and the second input of the second AND circuit 277 is coupled to an output 282 of the flip-flop 259. The processor 12 also has a fourth flip-flop 283 whose output 284 is connected to the input of the pulse generator 262, a second delay element 285 using a known circuit, an output 286 whereof is connected to the first input of the flip-flop 283, and a fourth OR circuiut 287 having its output connected to an output 288 of the delay element 285. One of the inputs of the OR circuit 287 is connected to the output 273 of the distributor 257. The processor 12 is also provided with a third AND circuit 289 and a fourth AND circuit 290 having their outputs coupled to other inputs 291 of the OR circuit 287.

A first input 292 of the OR circuit 289 is coupled to the first output of the distributor 255, while each of the remaining inputs of the OR circuit 289 coincides with a respective one of inputs $14_{2-1}, \ldots, 14_{2-i}$ of the group of inputs $14_1, \ldots, 14_n$ (FIG. 1) of the processor 12 is coupled to the outputs of respective judges' panels 1. A first input 293 (FIG. 8) of the AND circuit 290 is connected to the third output of the distributor 255, while the other inputs coincide with the inputs $42_3$, $42_4$ of the group of inputs $42_1, \ldots, 42_n$ (FIG. 1) of the processor 12 and are coupled, respectively, to the outputs 99 (FIG. 2) of the flip-flops 96 of the on-line judges' panels 40 (FIG. 1). The processor 12 (FIG. 8) is additionally provided with a fifth OR circuit 294 whose input is connected to the output 265 of the delay element 264, while an output 295 thereof is connected to the second inputs of the flip-flops 260 and 283 as well as to the reset inputs of the binary counter 235 and distributor 257. The processor is further provided with gate units $296_1$, $296_2$, $296_{3-1}, \ldots, 296_{3-i}$, $296_4$, $296_5$, $296_6$, $296_{7-1}, \ldots, 297_i$, $296_8$, $296_9$, $296_{10}$ and $296_{11}$ (where i = 4) whish are similar to one another and each of these gate units includes AND circuits $297_1, \ldots, 297_i, \ldots, 297_k, \ldots, 297_n$ (FIG. 10) whose first inputs are interconnected and coupled to a control input 298 of each one of the gate units $296_1, \ldots, 296_{11}$ (FIG. 8), second inputs are connected to inputs $299_1, \ldots, 299_i, \ldots, 299_k, \ldots, 299_n$ of the gate units $296_1, \ldots, 296_{11}$, and outputs are connected to outputs $300_1, \ldots, 300_i, 300_k, \ldots, 300_n$ of the gate units $296_1, \ldots, 296_{11}$. The inputs $299_1, \ldots, 299_n$ (FIG. 10) of the first gate unit $296_1$ (FIG. 8) are coupled to respective outputs 272 of the reversible binary counter 269.

The processor 12 also includes a group of OR circuits 301 with OR circuits $301_1, \ldots, 301_i, \ldots, 301_k, \ldots, 301_n$ having their first inputs connected to the outputs $300_1, \ldots, 300_n$ (FIG. 10) of the gate unit $296_1$ (FIG. 8), the inputs of the second gate unit $296_2$ coinciding with the inputs $18_1$ of the group of inputs $18_1, \ldots, 18_n$ (FIG. 1) of the processor 12 and being connected to the outputs 233 (FIG. 7) of the memory register 177, while the outputs $300_1, \ldots, 300_n$ (FIG. 10) of the gate unit $296_2$ (FIG. 8) are connected to the second inputs of the group of OR circuits 301. The processor 12 further includes a fifth flip-flop 302 whose first output is connected to the control input 298 (FIG. 10) of the gate unit $296_1$ (FIG. 8) and whose second output is connected to the input 298 (FIG. 10) of the gate unit $296_2$ (FIG. 8). The first input of the flip-flop 302 is coupled to the output $239_n$ of the coincidence circuit $237_n$. The processor 12 also has a programming device 303 which includes shapers 49 with push-button switches 304 connected to their inputs, a coder 305 whose inputs 306 are connected to the outputs of the programming device 303, a second pulse generator 307 using a conventional circuit, and a fifth AND circuit 308 whose first input 309 is connected to the output of the pulse generator 307 and output coincides with the outputs $13_1$ and $41_1$ of the groups of outputs $13_1, \ldots, 13_n$ and $41_1, \ldots, 41_n$ (FIG. 1) of the processor 12 and is coupled to the input 101 (FIG. 2) of the AND circuit 91 of a respective judge's panel 1 (FIG. 1) and on-line judge's panel 40. The inputs of the third gate units $296_{3-1}, \ldots, 296_{3-i}$ (FIG. 8) coincide, respectively, with the inputs $14_1, \ldots, 14_i$ of the group inputs $14_1, \ldots, 14_n$ (FIG. 1) of the processor 12 and are coupled to the outputs 117 (FIG. 2) of the memory register 44 of the judges' panels 1 (FIG. 1). The control inputs 298 (FIG. 10) are interconnected and coupled to the second input of the AND circuit 308, coinciding with the input $16_1$ of the group of inputs $16_1, \ldots, 16_n$ (FIG. 1) of the processor 12 and being connected to the output 151 (FIG. 6) of the flip-flop 148 of the superior judge's panel 2 (FIG. 1). The outputs of the gate unit $296_1$ (FIG. 8), memory register 271 and gate units $296_{3-1}, \ldots, 296_{3-i}$ coincide with the outputs $15_1$ of the group of outputs $15_1, \ldots, 15_n$ (FIG. 1) of the processor 12 and are connected, respectively, to the inputs 168 (FIG. 6) of the digital display unit 165 of the superior judge's panel 2 (FIG. 1). The inputs of the fourth gate unit $296_4$ coincide with the inputs $16_2$ of the group of inputs $16_1, \ldots, 16_n$ (FIG. 1) of the processor 12 and are coupled to the outputs 167 (FIG. 6) of the memory register 120 of the superior judge's panel 2 (FIG. 1). The inputs of the fifth gate unit $296_5$ (FIG. 8) coincide with the inputs $18_2$ of the group of inputs $18_1, \ldots, 18_n$ (FIG. 1) of the processor 12 and are associated with the group of outputs 232 (FIG. 7) of the memory register 176 of the scorer's panel 9 (FIG. 1). The inputs of the sixth gate unit $296_6$ (FIG. 8) are connected to outputs 310 of the coder 305. The inputs of the seventh gate units $296_{7-1}, \ldots, 296_{7-i}$ coincide with respective inputs $14_{1-1}, \ldots, 14_i$ of the group of inputs $14_1, \ldots, 14_n$ (FIG. 1) of the processor 12 and are coupled to the outputs 177 (FIG. 2) of the memory registers 44 of the judges' panels 1 (FIG. 1). The inputs of the eighth gate unit $296_8$ (FIG. 8) coincide with the inputs 21 of the group of inputs $21_1, \ldots, 21_n$ (FIG. 1) of the processor 12 and are connected to the outputs of the stop watch 4. The inputs of the ninth gate unit $296_9$ (FIG. 8) are connected to outputs 311 of the adder 236. The inputs of the tenth gate unit $296_{10}$ are coupled to outputs 312 of the memory register 271. The inputs of the eleventh gate unit $296_{11}$ are connected to outputs $313_1, \ldots, 313_n$ of the group of OR circuits 301.

In the processor 12, there are also a third distributor 314 using a known circuit, whose outputs are connected to the control units 298 (FIG. 10) of the gate units $296_4, \ldots, 296_{11}$ (FIG. 8) and a third pulse generator 315 also using a known circuit, whose output 316 is connected to the input of the distributor 314, coincides with the output $20_1$ of the groups of outputs $20_1, \ldots, 20_n$ (FIG. 1) of the processor 12, and is associated with the input of the digital printer 11. The processor 12 also includes a sixth flip-flip 317 with its output 318 being connected to the input of the pulse generator 315, a second group of OR circuits 319 including OR circuits $319_1, \ldots, 319_n$ intended for digitwise collection of information from the outputs $300_1, \ldots, 300_n$ (FIG. 10) of the gate units $296_1, \ldots, 296_n$ (FIG. 8), and a code converter 320 built around a conventional circuit, inputs 321 whereof are connected to the outputs of the group of OR circuits 319 and the outputs coincide with the outputs $20_2$ of the group of outputs $20_1, \ldots, 20_n$ (FIG. 1) of the processor 12 and are coupled to the inputs of the printer 11. The processor 12 also comprises a seventh flip-flop 322 and an eighth flip-flop 323 whose first input coincides with the input $16_3$ of the group of inputs $16_1, \ldots, 16_n$ (FIG. 1) of the processor 12 and is coupled to the output 172 (FIG. 6) of the command unit 169 of the superior judge's panel 2 (FIG. 1). The first input of the flip-flop 322 (FIG. 8) coincides with the input $16_4$ of the group of inputs $16_1, \ldots, 16_n$ (FIG. 1) of the processor 12 and is coupled to the output 173 (FIG. 6) of the command unit 169 of the superior judge's panel 2 (FIG. 1).

The processor 12 further comprises a sixth OR circuit 324 (FIG. 8) whose output 325 is connected to the first input of the flip-flop 317, coincides with the output $26_1$ of the group of outputs $26_1, \ldots, 26_n$ (FIG. 1) of each specialized digital device 25 and is associated with the input of the interface 5. In the processor 12 (FIG. 8), there is also a ninth flip-flop 326 with its first input being connected to the output 325 of the OR circuit 324 and the second input coinciding with the input 27 (FIG. 1) of each specialized digital device 25 and being connected to the output of the interface 5.

The processor 12 additionally comprises a sixth AND circuit 328 and a seventh AND circuit 329, both having their first inputs connected to an output 330 of the flip-flop 326. The output 321 of the flip-flop 322 and an output 332 of the flip-flop 323 are connected to the inputs of the OR circuit 324 and to the second inputs of the AND circuits 328 and 329. An input 333 of the distributor 314 is connected to the second input of the flip-flop 317 as well as the third inputs of the AND circuits 328 and 329.

The processor 12 also has a seventh OR circuit 334 whose inputs are connected to an output 335 of the AND circuit 328 and to an output 336 of the AND circuit 329, and a third delay element 337 with its input being connected to an output 338 of the OR circuit 334 and output 339 being connected to the second input of the flip-flop 302, to the reset inputs of the memory register 217, reversible binary counter 269 and distributor 255, as well as to the second input of the flip-flop 268 and second input of the OR circuit 294. The output 339 of the delay element 337 coincides with the outputs $13_2$ and $41_2$, respectively, of the groups of outputs $13_1, \ldots, 13_n$ and $41_1, \ldots, 41_n$ of the processor 12 and is coupled to the input 98 (FIG. 2) of the flip-flop 96 of a respective judges's panel 1 (FIG. 1) and on-line judge's panel 40. The output 339 of the delay element 337 also coincides with the output $15_2$ of the group of outputs $15_1, \ldots, 15_n$ of the processor 12 and is associated with the input 150 (FIG. 6) of the flip-flop 148 of the superior judge's panel 2 (FIG. 1).

The processor 12 also comprises a fourth delay element 340 (FIG. 8) using a known circuit, whose input is connected to the output 339 of the delay element 337 and whose ouput 341 is coupled to the reset input of the distributor 314 and to the second inputs of the flip-flops 322 and 323, and a fifth delay element 342 also using a known circuit, the input whereof is connected to the output 336 of the OR circuit 329, an output 343 of the fifth delay element 342 coinciding with the outputs $13_{3,\ 413}$ and $15_3$ of, respectively, the groups of outputs $13_1, \ldots, 13_n$ (FIG. 1), $41_1, \ldots, 41_n$ and $15_1, \ldots, 15_n$ of the processor 12 as well as with the output 17 (FIG. 8) of the group of outputs $17_1, \ldots, 17_n$ (FIG. 1) of the processor 12 and is connected to the input 69 (FIG. 2) of the OR circuit 67 and to the input 113 of the OR circuit 111 of a respective judge' s panel 1 (FIG. 1) and on-line judge's panel 40. The output 343 of the delay element 342 is connected to the input 139 (FIG. 6) of the OR circuit 137 and to the input 163 of the OR circuit 161 of the superior judge's panel 2 (FIG. 1) as well as to the input 220 (FIG. 7) of the scorer's panel 9 (FIG. 1).

Finally, the processor 12 (FIG. 8) comprises an eighth OR circuit 344, one inputs whereof coincides with the input $16_3$ of the group of inputs $16_1, \ldots, 16_n$ (FIG. 1) of the processor 12 and is connected to the output 169 (FIG. 6) of the command unit 172 of the superior judge's panel 2 (FIG. 1), the second input coincides with the input $18_3$ (FIG. 8) of the group of inputs $18_1, \ldots, 18_n$ (FIG. 1) of the processor 12 and is connected to the output 206 (FIG. 7) of the OR circuit 203 of the scorer's panel 9 (FIG. 1), and the output coincides with the output $19_1$ (FIG. 8) of the group of outputs $19_1, \ldots, 19_n$ (FIG. 1) of the processor 12 and is connected to the input of the luminous display unit 3.

The luminous display unit 3 (FIG. 11) comprises a threeface luminous display board 345 for displaying the number of a competitor and his final score for the execution of an exercise, including luminous spots $346_{1-1}, \ldots, 346_{1-n}, \ldots, 346_{n-1}, \ldots, 346_{n-n}$ each consisting of a transistor 347 (FIG. 12) and resistors 348 and 349 connected to the base of the transistor 347 as well as to a bias source and an input 350, respectively, of the luminous spots $346_{1-1}, \ldots, 346_{1-n}, \ldots, 346_{n-l}, \ldots, 346_{n-n}$, as well as a grooup of green lamps 351 for displaying, on the three-face luminous display board 345 (FIG. 11), information in green colour and a group of red lamps 352 (FIG. 12) for displaying the same information in red colour. The first common points of the groups of lamps 351 and 352 are coupled, via decoupling diodes 353 and 354, to the collector of the transistor 347, while the second common points of these groups of lamps are connected to inputs 355 and 356 of the luminous spots $346_{1-1}, \ldots, 346_{1-n}, 346_{n-1}, \ldots, 346_{n-n}$.

Figure 13:
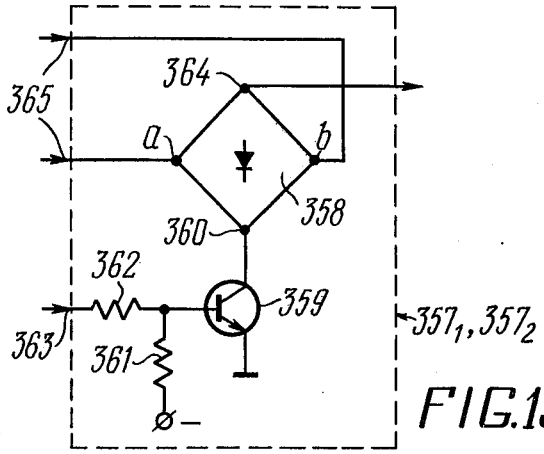
FIG. 13 is an electric circuit diagram of a power switch, according to the invention.

The luminous display unit 3 (FIG. 11) also comprises power switches $357_1$ and $357_2$ (FIG. 13), each including a diode bridge 358, a transistor 359 whose collector is connected to an output 360 of the diode bridge 358, as well as resistors 361 and 362 connected to the base of the transistor 359 and, respectively, to a bias source and an input 363 of the power switches $357_1$ and $357_2$. An output 364 of the diode bridge 358 is connected to the output of each one of the power switches $357_1$ and $357_2$, while inputs 365 of each one of the power switches $357_1$ and $357_2$ are associated with the diagonal a–b of the diode bridge 358.

Figure 11:
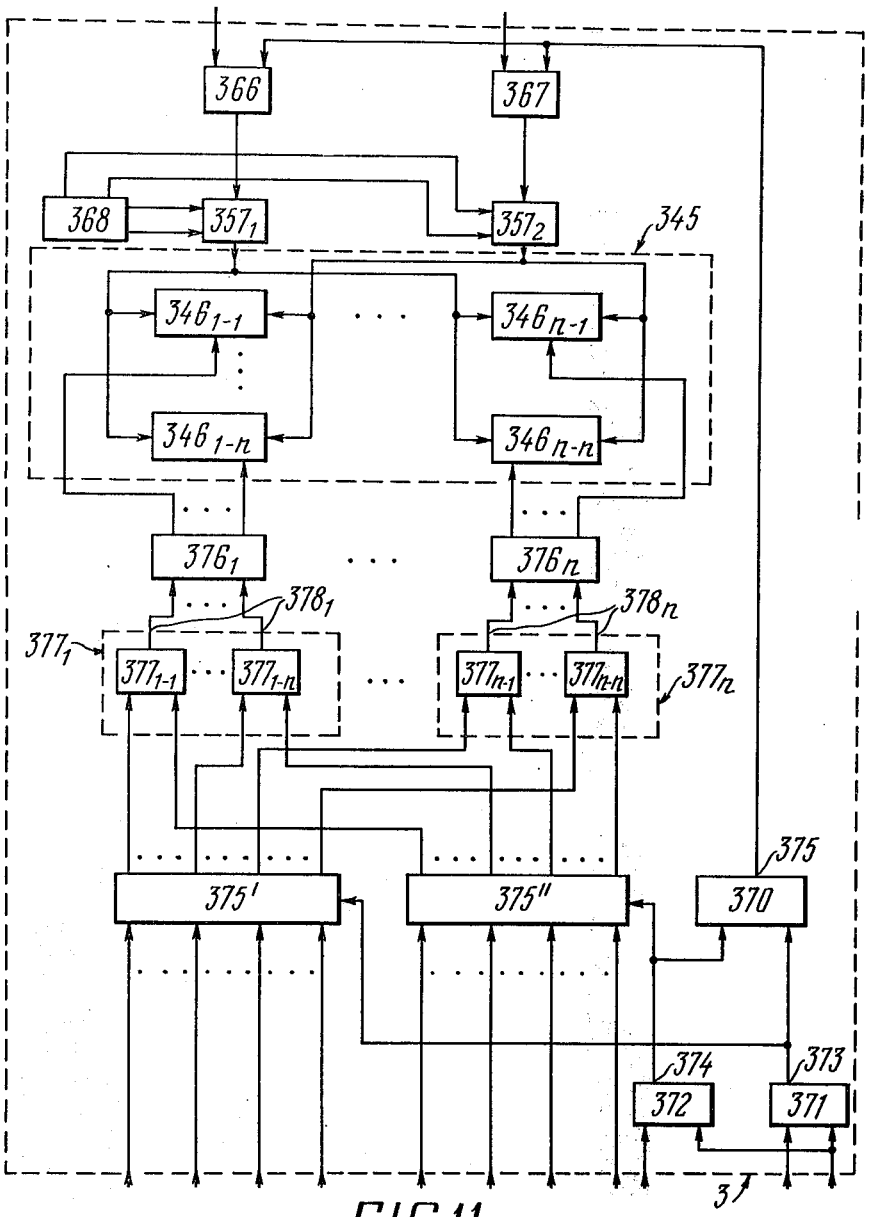
FIG. 11 is a functional diagram of the luminous display unit, according to the invention.
Figure 14:
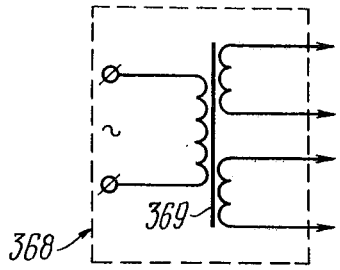
FIG. 14 is an electric circuit diagram of the power supply, according to the invention.
Figure 12:
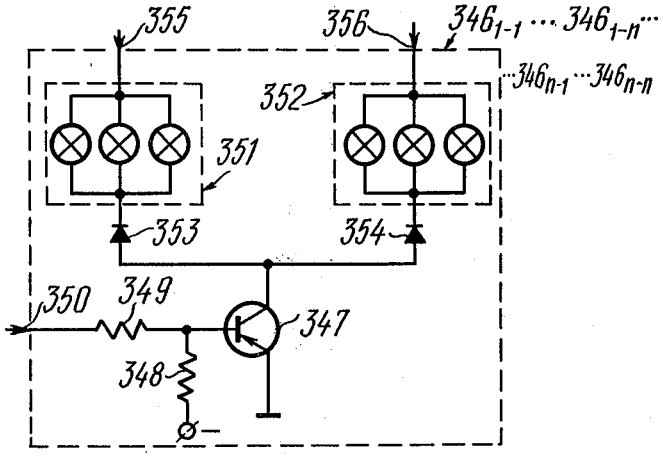
FIG. 12 is an electric circuit diagram of a luminous spot, according to the invention.

The luminous display unit 3 (FIG. 11) further comprises a first AND circuit 366 and a second AND circuit 367. The first input of the AND circuit 366 is connected to the output 227 (FIG. 7) of the flip-flop 217 of the scorer's panel 9 (FIG. 1). The first input of the AND circuit 367 (FIG. 11) is connected to the output 228 (FIG. 7) of the flip-flop 217 of the scorer's panel 9 (FIG. 1). The output of the AND circuit 366 (FIG. 11) is connected to the input 363 (FIG. 13) of the power switch $357_1$ (FIG. 11), and the output of the AND circuit 367 is connected to the input 363 (FIG. 13) of the power switch $357_2$ (FIG. 11). The luminous display unit 3 additionally comprises a power supply 368 (FIG. 14) which is arranged as an insulating transformer 369 with a secondary winding being connected to the inputs 365 (FIG. 13), and another secondary winding being connected to the inputs 365 (FIG. 12) of the power switch $357_2$ (FIG. 11). The output of the power switch 357 (FIG. 11) is coupled to the input 355 (FIG. 12) of respective luminous spots $346_{1-1}, \ldots, 346_{1-n}, \ldots, 346_{n-1}, \ldots, 346_{n-n}$ of the three-face luminous display board 345 (FIG. 11), while the output of the power switch $357_2$ (FIG. 11) is connected to the input 356 (FIG. 12) of respective luminous spots $346_{1-1}, \ldots, 346_{1-n}, \ldots, 346_{n-1}, \ldots, 346_{n-n}$ of the three-face luminous display board 345 (FIG. 11).

Figure 7:
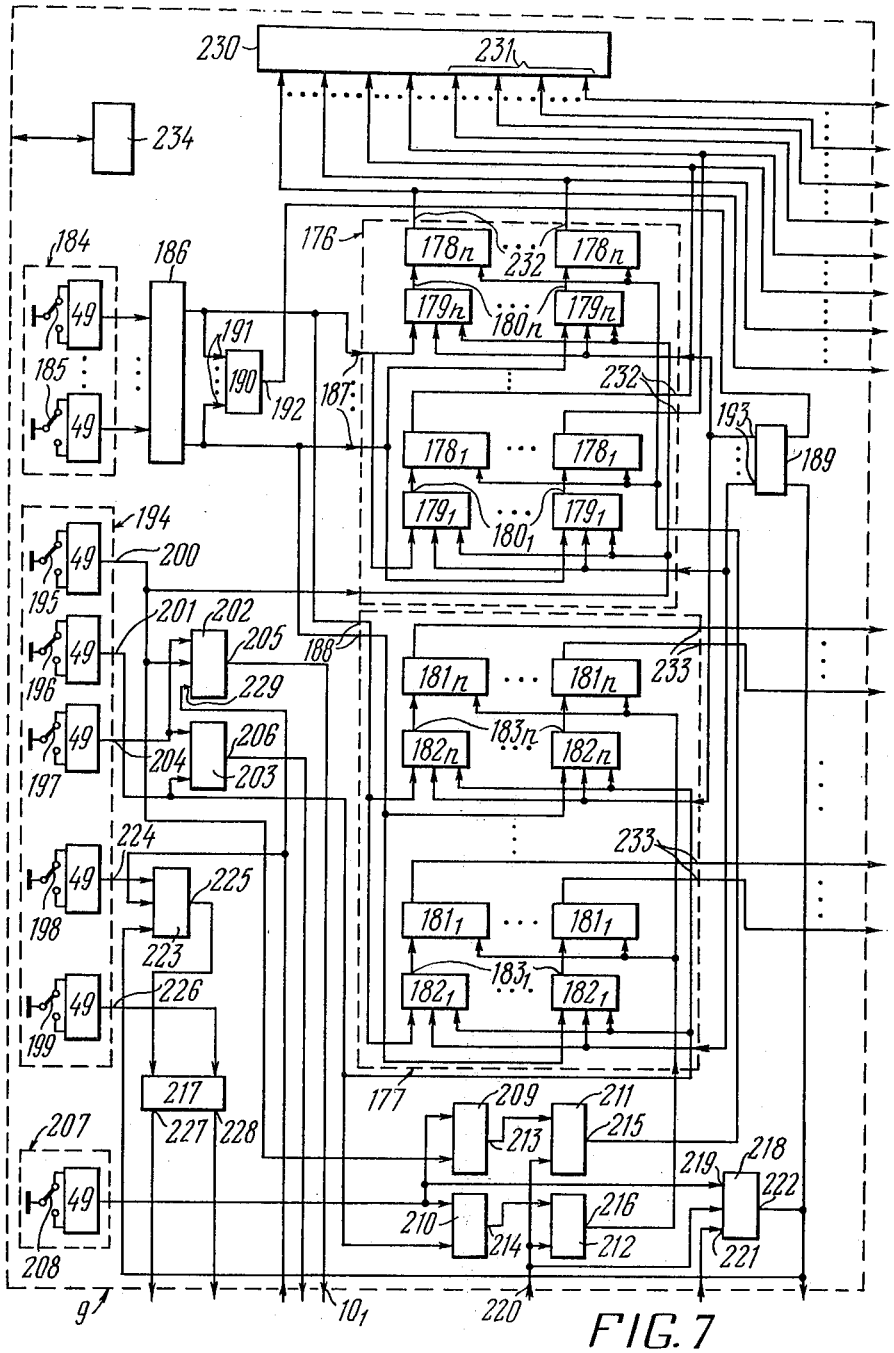
FIG. 7 is a functional diagram of the scorer's panel, according to the invention.

In the luminous display unit 3 there are also an OR circuit 370, a first flip-flop 371 and a second flip-flop 372, intended to control the display on the three-face luminous display board 345, respectively, the number of a competitor and the final score awarded thereto. The first input of the flip-flop 371 of the luminous display unit 3 is connected to the output 205 (FIG. 7) of the OR circuit of the scorer's panel 9 (FIG. 1). The first input of the flip-flop 372 (FIG. 11) of the luminous display unit 3 is connected to the output $19_1$ (FIG. 8) of the group of outputs $19_1, \ldots, 19_n$ (FIG. 1) of the processor 12. The second inputs of the flipflops 371 (FIG. 11) and 372 are interconnected and coupled to the output 222 (FIG. 7) of the OR circuit 218 of the scorer's panel 9 (FIG. 7). An output 373 (FIG. 11) of the flipflop 371 and an output 374 of the flip-flop 372 are connected to the inputs of the OR circuit 370 whose output 375 is connected to the second inputs of the AND circuits 366 and 367. The luminous display unit 3 also has gate units 375′ and 375″ which are similar to the gate units $296_1, \ldots, 296_{11}$ (FIG. 10), the inputs $299_1, \ldots, 299_n$ (FIG. 10) of the gate unit 375′(-FIG. 11) being connected to the outputs 232 (FIG. 7) of the memory register 176 of the scorer's panel (FIG. 1) and the inputs $299_1, \ldots, 299_n$ (FIG. 10) of the gate unit 375″ (FIG. 11) being connected to the outputs $313_1, \ldots, 313_n$ (FIG. 8) of the group of OR circuits 301, coinciding with the outputs $19_2$ of the group of outputs $19_1, \ldots, 19_n$ (FIG. 1) of the processor 12. The control input 298 (FIG. 10) of the gate unit 375′ (FIG. 11) is connected to the output 373 of the flip-flop 371, and the control input 298 (FIG. 10) of the gate unit 375″ (FIG. 11) is connected to the output 374 of the flip-flop 372. The luminous display unit 3 (FIG. 11) also includes code converters $376_1, \ldots, 376_n$, the outputs whereof are connected to respective inputs 350 (FIG. 12) of the luminous spots $346_{1-1}, \ldots, 346_{1-n}, \ldots, 346_{n-1}, \ldots, 346_{n-n}$ of the three-face luminous display board 345 (FIG. 11), as well as groups of OR circuits $377_1, \ldots, 377_n$ including OR circuits $377_{1-1}, \ldots, 377_{1-n}, \ldots, 377_{n-1}, \ldots, 377_{n-n}$ whose outputs $378_1, \ldots, 378_n$ are connected to the inputs of respective code converters $376_1, \ldots, 376_n$, some of the inputs of the group of OR circuits $377_1, \ldots, 377_n$ being connected to the outputs $300_1, \ldots, 300_n$ (FIG. 10) of the gate unit 375′ (FIG. 11) and the remaining inputs of the group of OR circuits $377_1, \ldots, 377_n$ being connected to the outputs $300_1, \ldots, 300_n$ (FIG. 10) of the gate unit 375″ (FIG. 11).

The automatic information system for the organization of gymnastic competitions operates as follows.

In each event of an all-around gymnastic competition, the scorer introduces, into each specialized digital device 25 of his panel 9 (FIG. 1), the number of the competitor that has been called, then transmits this number to the luminous display unit 3.

To accomplish this, the scorer operates the push-button switch 195 (FIG. 7) of the command unit 194 with the result that a signal permitting the entry of information in the memory register 176 appears at the output 54 (FIG. 3) of the shaper 49, coinciding with the output 200 (FIG. 7) of the command unit 176.

When the push-button switch 195 is operated, a signal 0 is applied to the input 53 (FIG. 3). The AND-NOT circuit 51 is blanked and remains in the blanked state due to a feed back being applied from the output 54 coinciding with the output of the AND-NOT circuit 51 to the input of the AND-NOT circuit 51 through the AND-NOT circuit 51.

As the push-button switch 195 (FIG. 7) is released, a signal 0 is applied to the input 52 (FIG. 3) of the shaper 49 (FIG. 7), which brings the shaper 49 back to the initial state. Then, as the push-button switches 185 of the data input device 184 are successively operated, the number of the competitor is entered digitwise, starting with the top digit, in the memory register 176 with the aid of the shapers 49 of the input device 184 and coder 186. When one of the push-button switches 185 is pressed, the signal at the output 192 of the OR circuit 190 shifts the distributor 189 through one stop, thereby providing for an automatic selection of the flip-flops $178_1, \ldots, 178_n$ of the memory register 176 during the digitwise entry of the number of the competitor. The flip-flops $178_1, \ldots, 178_n$ receive entry signals from the outputs $180_1, \ldots, 180_n$ of those AND circuits $179_1, \ldots, 179_n$ which have enable signals at their three inputs from the output 200 of the command unit 194, outputs 193 of the distributor 189 and outputs of the coder 186, the latter outputs coinciding with the inputs 187 of the memory register 176.

The code of the entered number of the competitor is applied from the outputs $232_1, \ldots, 232_n$ to the group of inputs of the digital display unit 230 for the scorer to carry out a visual self-check; at the same time, the code passes through the group of outputs $10_1, \ldots, 10_n$ (FIG. 1) of the scorer's panel 9 on to the inputs of the gate units 375 (FIG. 11) of the luminous display unit 3 (FIG. 1); Thereafter, the scorer operates the push-button switch 197 (FIG. 7) of the command unit 194. The shaped signal from the output 204 of the command unit 194 is fed to the input of the OR circuit 202. In the absence of a disable signal at the input 229 of the OR circuit 202 from the output 35 (FIG. 1) of the displatcher's panel 32, the signal from the output 205 (FIG. 7) of the OR circuit 202 is applied to the input of the flip-flop 371 (FIG. 11) of the luminous display unit 3 (FIG. 1), whereby the flip-flop 371 changes its state. With the aid of a signal applied from the output 373 (FIG. 11) of the flip-flop 371 to the control input 298 (FIG. 10) of the gate unit 375' (FIG. 11), the code of the competitor's number is delivered through the AND circuits $297_1, \ldots, 297_n$ (FIG. 10) of the gate unit 375' (FIG. 11) to the inputs of the groups of OR circuits $377_1, \ldots, 377_n$.

From the outputs $378_1, \ldots, 378_n$, the code of the competitor's number is then applied to the inputs of the code converters $376_1, \ldots, 376_n$ which convert the input code into a code controlling the shaping of symbols on the three-side luminous display board 345 in accordance with the information introduced at the scorer's panel 9 (FIG. 1). A signal from the output 373 of the flip-flop 371 is fed through the OR circuit 370 to the inputs of the AND circuits 366 and 367. A signal from the outputs 227 (FIG. 7) of the flip-flop 217 is applied via the AND circuit 366 (FIG. 11) to the input 363 (FIG. 13) of the power switch $357_1$ (FIG. 11). Applied to the inputs 365 (FIG. 13) of the power switch $357_1$ is alternating voltage from a secondary winding of the insulating transformer 369 (FIG. 14) of the power supply 368 (FIG. 11). Pulses of the rectified current pass through the conducting transistor 359 (FIG. 13) from the output 364 of the diode bridge 358 to the inputs 355 (FIG. 12) of all the luminous spots $346_{1-1}, \ldots, 346_{1-n}, \ldots, 346_{n-1}, \ldots, 346_{n-n}$ (FIG. 11). The transistors 347 (FIG. 12) of those ones of the luminous spots $346_{1-1}, \ldots, 346_{1-n}, \ldots, 346_{n-1}, \ldots, 346_{n-n}$ (FIG. 11) to the inputs 350 whereof zero potentials are applied from the code converters $376_1, \ldots, 376_n$ are rendered conducting by the base current of the transistor 347, which flows through the circuit of the resistor 348 (FIG. 12) from the negative terminal of the power supply. The conducting transistors 347 close the circuit of the rectified current through the decoupling diodes 353 and lamps 351 which come on and display the number of a competitor on the three-face luminous display board 345 (FIG. 11), in red colour thereby informing the competitor that he is going to be invited to his apparatus.

Having done all this, the scorer gives his permission for the competitor to start the exercise on a given apparatus. The permission consists in that the number of the competitor, displayed on the three-face luminous display board 345 changes colour, from red to green as a result of the push-button switch 199 (FIG. 7) of the command unit 194 of the scorer's panel 9 (FIG. 1) being pressed by the scorer. A signal from the output 226 (FIG. 7) of the command unit 194 sets the flip-flop 217 to the other stable state.

A signal from the output 228 of the flip-flop 217 is applied to the input of the AND circuit 367 (FIG. 11) of the luminous display unit 3 (FIG. 1), and an enable signal is derived from the output of the AND circuit 366 (FIG. 11) with the result that the power switch $357_2$ is opened and the power switch $357_1$ is closed. In the luminous spots $346_{1-1}, \ldots, 346_{1-n}, \ldots, 346_{n-1}, \ldots, 346_{n-n}$ (FIG. 12), the lamps 351 come off and the lamps 352 come on, whereby the competitor's number is now displayed in gree. Simultaneously with the formation of a command permitting the competitor to start the exercise, a disable signal is applied to the input 23 (FIG. 1) of the intercommunication unit 22 from the output 227 (FIG. 7) of the flip-flop 217 of the scorer's panel 9 (FIG. 1), whereby no conversation may take place between judges.

As soon as the competitor sees his number turn green on the three-face luminous display board 345, he starts executing the exercise. The judges, operating the panels 1 (FIG. 1), proceed to evaluating the performance and making the necessary deductions for faults in execution. The resulting score is expressed in conventional digits and is registered in the counters 103 (FIG. 2) of the judges' panels 1 in increments by way of pressing the push-button switches 105 of the information input devices 104. For individual checking of the state of the counters 103, it is displayed in the digitaldisplay unit 115.

The exercise being completed, the judges evaluate the performance and enter the scores they have awarded to the competitor in the memory register 44 (FIG. 2), then in the record-keeping unit 75 of the judges' panels 1 (FIG. 1), wherefrom the score is passed on to the processor 12.

Each judge enters the score he has awarded by pressing the push-button switches 55 (FIG. 2) of the score input device 48. The score is entered starting with the top digit. The code each digit of the score is applied from the output of the coder 56 to the inputs 57 of the memory register 44 and to the inputs 59 of the OR circuit 58. When any one of the push-button switches 55 is pressed, the distributor 61 is shifted through one step, whereby the digit flip-flops $45_1, \ldots, 45_n$ of the memory register 44 can be automatically selected when the score is being entered digitwise. The flip-flops $45_1, \ldots, 45_n$ receive enter pulses from the outputs $47_1, \ldots, 47_n$ of those AND circuits $46_1, \ldots, 46_n$ both inputs whereof have received enable pulses from the outputs 63 of the distributor 61 and from the outputs of the coder 56, coinciding with the inputs 57 of the memory register 44. The code of the entered score is sent from the outputs 117 of the memory register 44 to the input of the digital display unit 115 for visual verification of the score.

Should a judge find it necessary to change the score, he presses the push-button switch 66 of the resetting means 65, whereby he resets, through the OR circuit 67 as well as AND circuit 70 the memory register 44, via the input 73, and the distributor 61, via the input 72, and may introduce a new score.

Having thus composed the score, the judge writes it down on the paper tape 79 (FIG.4) through the slot 85 of the mechanism 76 (FIG.2) forming part of the record-keeping unit 75. Then, the judge shifts the arm 82 (FIG.4) forward to the maximum. The arm 82 aided by the pawl 83 and ratchet 80 turns the elastic driven roller 78. The paper tape 79, pressed against the driven roller 78 by the roller 81, is moved through a preset distance in the gap between the base 87 and cover 84 of the mechanism 76. The score written down on the paper tape 79 is shifted under the transparent plate 86 thus becoming legible, and the judge cannot change the score any more since it is now under the transparent palet 86; the facs of entering the score in the record (in the record-keeping unit 75 (FIG.2)) is registered by means of the limit switch 77 which interacts with the arm 82 (FIG.82) the latter being in the extreme forward position.

As the limit switch 77 (FIG. 2) operates, a signal appears at the output 88 of the record-keeping unit 75, which, in the presence of a signal at the input 89 of the AND circuit 74, sets the flip-flop 96 to the opposite stable state. The signal at the input 89 of the AND circuit 74 appears if signals from the outputs 63 of the distributor 61 have arrivad at one of the inputs of the OR circuit 60, i.e. after the score has been composed. A signal from the output 100 of the flip-flop 96 prevents passage through the AND circuit 70 of a signal resetting the memory register 44 and distributor 61. Besides, this signal prevents passage of a signal from the output 109 of the counter resetting means 106 through the AND circuit 108 and OR circuit 111 to the reset inputs 114 of the counters 103. A signal is applied from the output 99 of the flip-flop 96 to the inputs $14_2$ (FIG. 8) of the group of inputs $14_1, \ldots, 14_n$ (FIG. 1) of the processor 12.

As a competitor is executing an exercise in each event of an all-around competition, the superior judge acts in a manner like the judges, i.e. he evaluates the performance from the point of view of difficulty of individual elements of the exercise, takes notice of the faults occurring during the execution of the exercise, introduces the score in the memory register and record-keeping unit of his panel 2, then passes it to the processor 12. The numeric values of the points awarded for executing difficult elements of the exercise and deducted for the faults in execution are registered in the counters 153 (FIG. 6) of the superior judge's panel 2 (FIG. 1) as the superior judge presses respective push-button switches 155 (FIG. 6) of the score input devices 54. To provide for individual checking of the state of the counters 153, it is displayed in the digital display unit 165. The superior judge enters the score by successively pressing the push-button switches 125 of the input device 124, starting with the top digit. The code of each digit of the score is applied from the outputs of the coder 126 to the inputs 127 of the memory register 120 and to the inputs 129 of the OR circuit 128. When anyone of the push-button switches 125 is pressed, the distributor is shifted through one step thereby providing for an automatic selection of the digit flip-flops $121_1, \ldots, 121_n$ of the memory register 120 as the score is being entered digitwise. The flip-flops $121_1, \ldots, 121_n$ receive enter pulses from the outputs $123_1, \ldots, 123_n$ of those AND circuits $122_1, \ldots, 122_n$, at both inputs whereof there are enable signals from the outputs 133 of the distributor 131 and inputs 127 of the memory register 120. The code of the entered score is delivered from the outputs 167 of the memory register 120 to the input of the digital display unit 165 for visual verification of the score.

When it becomes necessary to change the score, the superior judge presses the push-button switch 136 of the resetting means 135 to reset, through the OR circuit 137 and AND circuit 140, the memory register 120, via the input 143, and the distributor 131, via the input 142, and may introduce a new score. Having done this, the superior judge performs operations, with the aid of the record-keeping unit 145, similar to those performed by the judges with the aid of the record-keeping units 65 (FIG. 2) of the judges' panels 1 (FIG. 1). As soon as the limit switch 146 (FIG. 6) operates, a signal appears at the output 54 (FIG. 3) of the shaper 49 of the record-keeping unit 145, which, in the presence of a signal at the input 147 of the AND circuit 144 sets the flip-flop 148 to the opposite stable state.

The signal at the input 147 of the AND circuit 144 appears if signals from the outputs 133 of the distributor 131 are present at one of the inputs of the OR circuit 131, i.e. after the score has been composed. A signal from the output 152 of the flip-flop 148 prohibits passage of a signal resetting the memory register 120 and distributor 131 through the OR circuit 140. Besides, this signal also prohibits passage of a signal from the output 159 of the counter resetting means 156 via the OR circuit 158 and AND circuit 161 to the reset inputs 164 of the counters 153.

A signal from the outputs 151 of the flip-flop 148 is applied to the input $16_1$ (FIG. 8) of the group of inputs $16_1, \ldots, 16_n$ (FIG. 1) of the processor 12. At the same time, pulses from the pulse generator 307 (FIG. 8), applied to the input 309 of the AND circuit 308, pass through the AND circuit 308 and are fed, from the outputs $13_1$ and $41_1$ of the groups of outputs $13_1, \ldots, 13_n$ and $41_1, \ldots, 41_n$ (FIG. 1) of the processor 12, to the inputs 101 (FIG. 2) of the AND circuits 91 of the judges' panels 1 (FIG. 1) and on-line judges' panels 40.

In case a judge has not entered the score in the record, i.e. an enable signal is applied from the output 100 (FIG. 2) of the flip-flop 96 to the input of the AND circuit 91, pulses from the generator 307 (FIG. 8) are applied to the input 102 (FIG. 2) of the indication unit 90. As a control signal is applied to the input 102 of the indication unit 90, the transistor 93 (FIG. 5) of the indication unit 90 gets saturated and sets the lamp 92 alight in step with the pulses from the generator 307 (FIG. 8). The blinking light of the lamp 92 (FIG. 5) reminds the judges who have not entered the score in the record of the necessity to do so.

The score being entered in the record, a disable signal from the output 100 (FIG. 2) of the flip-flop 96 blanks the AND circuit 91 and the blinking of the lamp 92 (FIG. 5) of the indication unit 90 (FIG. 2) of the respective judge's panel 1 (FIG. 1) discontinues.

Only after the superior judge has entered his mark in the record he can see, on the digital display unit 165 (FIG. 6) of his panel, the scores awarded by the other judges who have entered their scores in the record-keeping unit of their panels 1 (FIG. 1). This is schieved by that a signal from the input $16_1$ (FIG. 8) of the group of inputs $16_1, \ldots, 16_n$ (FIG. 1) of the processor 12 is applied to the control inputs 298 (FIG. 10) of the gate units $296_{3-1}, \ldots, 296_{3-i}$ (FIG. 8) with the result that the codes of the scores awarded by the judges, fed from the outputs 117 (FIG. 2) of the memory registers 44 of the judges' panels 1 (FIG. 1) to the inputs $14_{1-1}, \ldots, 14_{1-i}$ of the processor 12, pass through the gate units $296_{3-1}, \ldots, 296_{3-i}$ (FIG. 8) to the inputs of the digital display unit 165 of the superior judge's panel 2 (FIG. 1).

The two on-line judges, who belong to the jury for floor exercises, register each instance of a competitor's stepping out of the floor exercise area, with the aid of their panels 40 (FIG. 1). Each on-line judge takes care of two borderlines of the floor exercise area.

To do this, each on-line judge presses the push-button switch 105 (FIG. 2) of the input device 104 of a respective panel 40 (FIG. 1). The competitor having executed the exercise, the total number of crossings, added up by the counter 103 (FIG. 2) is displayed on the digital display unit 115. Each on-line judge successively presses the push-button switches 55 of the input device 48 to enter the deduction made for stepping out of the floor exercise area in the memory register 44.

Having composed the deduction, the on-line judge enters it in the record with the aid of the record-keeping unit 65. Pulses from the generator 307 (FIG. 8) pass, after the superior judge has entered his mark in the record, from the output 41, of the group of outputs $41_1, \ldots, 41_n$ (FIG. 1) via the AND circuit 308 to the inputs 101 (FIG. 2) of the AND circuits 91 of the on-line judges' panels 40 (FIG. 1). The lamp 92 (FIG. 5) starts to blink thus reminding the on-line judges, who have forgotten to enter the deduction in the record, of the necessity to do so. The codes of the composed deduction are delivered from the outputs 117 of the memory registers of both on-line judges' panels 40 (FIG. 1) to the inputs $42_1$ and $42_2$ (FIG. 8) of the group of inputs $42_1, \ldots, 42_n$ (FIG. 1) of the processor 12 and further to the inputs of the adder 236 (FIG. 8), at the outputs whereof there appears the code of the total deduction made by both on-line judges.

Applied to the group of outputs $21_1, \ldots, 21_n$ (FIG. 1) of the processor 12 from the outputs of the stop watch 4 is the code of the deduction made for the competitor's going over the prescribed time limit.

After all the marks of all the judges have been entered in the record, the processor 12 automatically calculates the average score. For the calculation of the average score, the highest and lowest scores are disregarded and the arithmetic of the two middle marks is found. This is attained by comparing the codes of the scores from the outputs of the judges' panels 1, arriving through the inputs $14_{1-1}, \ldots, 14_{1-i}$ (FIG. 8) of the group of inputs $14_1, \ldots, 14_n$ (FIG. 1) of the inputs of the processor 12 at the inputs of the comparison circuits $237_1, \ldots, 237_i$ (FIG. 8).

After the record-keeping procedure has been completed by all the judges of a jury officiating at a particular event of an all-around gymnastic competition, enable signals are applied from the outputs 99 (FIG. 2) of the flip-flops 96 of the judges' panels 1 (FIG. 1) through the inputs $14_{2-1}, \ldots, 14_{2-i}$ (FIG. 8) of the group of inputs $14_1, \ldots, 14_n$ (FIG. 1) of the processor 12 to the inputs of the AND circuit 289. An enable signal is applied to the first input 292 (FIG. 8) of the AND circuit 289 from the first output of the first distributor 255. The output signal of the AND circuit 289 sets the flip-flop 283 to the opposite stable state through the OR circuit 287 and the delay element 285. A signal from the output 284 of the flip-flop 283 starts the pulse generator 262. Signals from the output 263 of the pulse generator 262 trigger the binary counter 235.

If the code applied to one of the inputs $249_1, \ldots, 249_i$ (FIG. 8) of each one of the comparison circuits $237_1, \ldots, 237_i$ coincides with the code applied to respective inputs $253_1, \ldots, 253_i$, all the circuits $244_1, \ldots, 244_n$ l(FIG. 9) and $245_1, \ldots, 245_n$ are blanked at the inputs $246_1, \ldots, 246_n$ and $252_1, \ldots, 252_n$ or, through the inverters $248_1, \ldots, 248_n$ and $251_1, \ldots, 251_n$, at the inputs $247_1, \ldots, 247_n$ and $250_1, \ldots, 250_n$. In this case, signals 0 are applied to the inputs 254 of the OR-NOT circuit 240 from the outputs of the blanked AND circuits $244_1, \ldots, 244_n$ and $245_1, \ldots, 245_n$. A signal 1 is applied from the output 241 of the OR-NOT circuit 240 to the input 242 of the AND circuit 238, and as the signal 1 appears at one of the control inputs $243_1, \ldots, 243_i$ (FIG. 8) of one of the comparison circuits $237_1, \ldots, 237_i$, it passes further to one of the outputs $239_1, \ldots, 239_i$ of one of the comparison circuits $237_1, \ldots, 237_i$. If the codes at the inputs $249_1, \ldots, 249_i$ and $253_1, \ldots, 253_i$ of each one of the comparison circuits $237_1, \ldots, 237_i$ do not coincide and a signal 1 appears at least one of the inputs 254 (FIG. 9) of the OR-NOT circuit 240, a signal 0 will appear at one of the outputs $239_1, \ldots, 239_i$ (FIG. 8) of each one of the comparison circuits $237_1, \ldots, 237_i$.

Applied to the control inputs $243_1, \ldots, 243_i$ of the comparison circuits $237_1, \ldots, 237_i$ is an enable signal 1 from the first output of the first distributor 255.

At the moment of coincidence of the output code of the binary counter 235 with the code at the inputs $253_1, \ldots, 253_i$ of one of the comparison circuits $237_i, \ldots, 237_i$, a signal is fed from one of the outputs $239_1, \ldots, 239_i$ of the comparison circuits $237_1, \ldots, 237_i$ through the OR circuit 256 to the input 258 of the second distributor 257 and sets it from position 0 to a first position.

Starting with a certain minimum values the output code of the binary counter 235 starts to increase. Therefore, the first coincidence of the codes at the inputs $249_1, \ldots, 249_i$ and $253_1, \ldots, 253_i$ of one of the comparison circuits $237_1, \ldots, 237_i$ corresponds to the minimum mark of all those coming from the judges of that particular event.

Signals from the output 263 of the pulse generator 262 are also applied, via the unblanked AND circuit 276 and OR circuit 274, to the input 275 of the reversible binary counter 269. An enable signal arrives at the AND circuit 276 from the output 280 of the flip-flop 260. The reversible binary counter is ready for direct counting following the arrival of a signal from the output of the flip-flop 268 at the input 270. The second coincidence of the codes at the inputs $249_1, \ldots, 249_i$ and $253_1, \ldots, 253_i$ of one of the comparison circuits $237_1, \ldots, 237_i$ corresponds to the first score which has to be averaged. In this case, a signal from one of the outputs $239_1, \ldots, 239_i$ of one of the comparison circuits $237_1, \ldots, 237_i$ sets, through the OR circuit 256, the distributor 257 to a second position, as it arrives at its input 258.

The state of the reversible binary counter 269 at the moment of the second coincidence corresponds to the code of the first score which has to be averaged. At the same time, a signal from the output of the distributor 257 is applied to the input 261 of the flip-flop 260 to set it to the opposite stable state. The AND circuit 276 is blanked by the signal 0 arriving from the output 280 of the flip-flop 260. Applied to the first input of the AND circuit 277 from the output 281 of the flip-flop 260 is a signal which enables pulses from the output 282 of the flip-flop 259 to pass through the AND circuit 277.

The flip-flop 259 functions as a frequency divider with a division ratio of two. Therefore, starting with the moment of the second coincidence of the codes, i.e. after the second score has been entered in the reversible binary counter 269, pulses from the output 282 of the flip-flop 259 will pass through the AND circuit 277 and OR circuit 274 to the input 275 of the reversible binary counter 269 at a frequency twice as low as that of the pulse generator 262.

When the codes at one of the inputs $249_1, \ldots, 249_i$ and $253_1, \ldots, 253_i$ of one of the coincidence circuits $253_1, \ldots, 253_i$ coincide for the third time, a signal from one of the outputs $239_1, \ldots, 239_i$ of one of the coincidence circuits $237_1, \ldots, 237_i$ sets, through the OR circuit 256, the distributor 257 to a third position, as it arrives at its input 258. At this moment, the state of the reversible binary counter 269 corresponds to the code of the average score.

The operation of averaging the score consists in the addition, in the reversible binary counter 269, of the total number of pulses of the code of the lower mark to half the difference between the codes of the higher and lower marks. For example, marks 9.20 and 9.30 are averaged as follows:

$$9.20 + \frac{9.30 - 9.20}{2} = 9.25.$$

As the distributor 257 is set to the third position, a signal from the output 273 of the distributor 257 is applied to the control input of the memory register 271 to enable the code of the average score to be entered from the outputs 272 of the reversible binary counter 269 in the memory register 271. Another signal from the output 273 of the distributor 257 is applied to the flip-flop 268 setting it to the opposite stable state. A signal from the output of the flip-flop 268 is applied to the input 270 of the reversible binary counter 269 preparing it for reverse count. Still another signal from the output 273 of the distributor 257 passes through the OR circuit 266 to the input 267 of the delay element 264 and a fourth signal passes through the OR circuit 287 to the input 288 of the delay element 285.

the signal arriving at the input 267 of the delay element 264 is delayed by a certain period of time and proceeds from the output 265 of the latter further to the input of the distributor 255 setting it to the second position. The same signal arrives at the input of the OR circuit 294, then, from the output 295 thereof, to the inputs of the flip-flop 260, distributor 257, flip-flop 283 and binary counter 235, bringing all these elements to the initial state.

A signal from the output 280 of the flip-flop 260 unblanks the AND circuit 276, while a signal from the output 284 of the flip-flop 283 stops the pulse generator 262.

The signal arriving at the input 288 of the delay element 285 is also delayed by a preset perior of time. The element 285 delays the signal by a longer period of time than the element 264. A signal from the output 286 of the delay element 285 is applied to the input of the flip-flop 283.

The pulse generator 262 is restarted by a signal from the output 284 of the flip-flop 283. A signal from the output of the distributor 255 is applied to the control input $243_k$ of the comparison circuit $237_k$ bringing it to the ready state. At the instant of coincidence of the codes at the inputs $249_k$ and $253_k$ of the comparison circuit $237_k$, a signal from the output $239_k$ of the comparison circuit $237_k$ is applied through the OR circuit 266 to the input 267 of the delay element 264. The signal arriving at the input 267 of the delay element 264 is delayed by a preset period of time and proceeds from the output 265 of the latter to the input of the distributor 255 setting it to the third position. This same signal is then applied to the input of the OR circuit 294 and further, from its output 295, to the inputs of the flip-flop 283 and binary counter 235. The flip-flop 283 and binary counter 235 are thus reset. A signal from the output 284 of the flip-flop 283 stops the pulse generator 262.

At this moment, the code of the reversible binary counter 269 corresponds to that of the average score minus the code of the deduction for exceeding the preset time limit. A signal is applied from the output of the distributor 255 to the control input $243_n$ of the coincidence circuit $347_n$, bringing it to the state of readiness, and to the input 293 of the AND circuit 290. From the output of the AND circuit 290, a signal is applied to one of the inputs 291 of the OR circuit 287. From the output of the OR circuit 287, the signal then passes to the input 288 of the delay element 285 and is delayed by a preset period of time. A signal from the output 286 of the delay element 285 is applied to the input of the flip-flop 283 and from the output 284 of the latter further to the pulse generator 262 restarting it.

At the moment of coincidence of the codes at the inputs $249_n$ and $253_n$ of the comparison circuit $237_n$, a signal from the output $239_n$ of the comparison circuit $237_n$ goes to the input 267 of the delay element 264 through the OR circuit 266. The signal arriving at the input 267 of the lement 264 is delayed by a preset period of time and from the output 265 of the latter passes further to the input of the OR circuit 294 and further, from its output 295, to the inputs of the flip-flop 283 and binary counter 235 resetting both. A signal from the output 284 of the flip-flop 283 stops the pulse generator 262.

At this moment, the code of the reversible binary counter 269 corresponds to the code of the average score minus the codes of the deductions made for exceeding the preset time limit and stepping out of the floor exercise area. A signal from the output $239_n$ of the comparison circuit $237_n$ is applied via the output $17_1$ of the group of outputs $17_1, \ldots, 17_n$ (FIG. 1) of the processor 12 to the input 221 (FIG. 7) of the OR circuit 218. From the output 222 of the OR circuit 218, a signal resets the flip-flop 217 through the OR circuit 223. At the same time, an enable signal is applied from the output 227 of the flip-flop 217 to the input 23 (FIG. 1) of the intercommunication unit 22 setting it in operation. From this moment on, the members of the jury may talk to one another.

A signal is applied from the output 222 (FIG. 7) of the OR circuit 218 through the group of outputs $10_1, \ldots, 10_n$ of the scorer's panel 9 (FIG. 1) to the interconnected inputs of the flip-flops 371 and 372 (FIG. 11). A signal from the output 373 of the flip-flop 371 blanks the AND circuits 366 and 367 through the OR circuit 360. The power switches $357_1$ and $357_2$ are blanked and the three-face luminous display board 345 is illuminated no more.

A signal from the output $239_n$ (FIG. 8) of the comparison circuit $237_n$ sets the flip-flop 302 to the opposite stable state. A signal from the output of the flip-flop 302 is applied to the control input 298 (FIG. 10) to unblank the gate unit $296_1$ (FIG. 8). The code of the final score is delivered from the output 272 of the reversible binary counter 269 to the inputs $299_1, \ldots, 299_n$ (FIG. 10) of the gate unit $296_1$ (FIG. 8), then, from the outputs $300_1, \ldots, 300_n$ (FIG. 10) of the gate unit $296_1$, to the inputs of the group of OR circuits 301 (FIG. 8).

From the outputs $313_1, \ldots, 313_n$ of the group of OR circuits 301, the code of the final score is fed to the inputs of the gate unit $296_{11}$.

The codes of the average and final errors are transferred from the outputs 312 of the memory register 271 and from the outputs $300_1, \ldots, 300_n$ (FIG. 10) of the gate unit $296_1$ (FIG. 8) through the outputs $15_1$ of the group of outputs $15_1, \ldots, 15_n$ (FIG. 1) of the processor 12 to the group of inputs 168 (FIG. 6) of the digital display unit 165 of the superior judge's panel 2 (FIG. 1).

The superior judge evaluates the information coming from the judges, i.e. the average and final scores, to the digital display unit 165 (FIG. 6) of the superior judge's panel 2 (FIG. 1).

If the superior judge is not satisfied with the marks of the judges, he gives a command to register the scores on the digital printer 11 and transmits the results (scores) to the computer 6 through the interface 5. This is done as follows.

The superior judge presses the push-button switch 171 (FIG. 6) of the command unit 169. A signal from the output 173 of the command unit 169 is applied to the input $16_4$ (FIG. 8) of the group of inputs $16_1, \ldots, 16_n$ (FIG. 1) of the processor 12 and sets the flip-flop 322 (FIG. 8) to the opposite stable state. A signal from the output 331 of the flip-flop 322 passes through the OR circuit 324 to the inputs of the flip-flops 317 and 326 setting them to the opposite stable state.

A signal from the output 318 of the flip-flop 317 starts the pulse generator 315. Signals from the output 316 of the pulse generator 315 arrive at the input of the distributor 314. The distributor 314 sends signals successively to the control inputs 298 (FIG. 10) of the gate units $296_4, \ldots, 296_{11}$ (FIG. 8). The code from the outputs $300_1, \ldots, 300_n$ (FIG. 10) of the gate units $296_4, \ldots, 296_{11}$ (FIG. 8) is fed in a respective sequence to the inputs of the group of OR circuits 319. From the outputs of the group of OR circuits 319, the code is applied to the inputs 321 of the code converter 300 wherein it is converted into the code of the digital printer 11 (FIG. 1) to be printed line by line on a paper tape, and is delivered through the outputs $20_2$ (FIG. 8) of the group of outputs $20_1, \ldots, 20_n$ (FIG. 1) of the processor 12 to the inputs of the digital printer 11. Simultaneously with the connection of each subsequent gate unit of the group of gate units $296_4, \ldots, 296_{11}$ to the digital printer 11 (FIG. 1), a pulse is applied from the output 316 of the pulse generator 315 (FIG. 8) via the output $20_1$ of the group of outputs $20_1, \ldots, 20_n$ (FIG. 1) of the processor 12 to the input of the digital printer 11 to prepare the latter for printing the next line. From the last output 333 of the distributor 314, a signal is applied to the input of the flip-flop 317 and to the inputs of the AND circuits 328 and 329. The flip-flop 317 is set to the opposite stable state. The pulse generator 315 is stopped by a signal from the output 318 of the flip-flop 317.

A signal from the output 325 of the OR circuit 324 is fed through the output $26_1$ of the group of outputs $26_1, \ldots, 26_n$ (FIG. 1) of the specialized digital device 25 to the request input of the interface 5. At the same time, information from the outputs $26_2, \ldots, 26_7$ (FIG. 8) of the processor 12 (FIG. 1), coinciding with the group of outputs $26_1, \ldots, 26_n$ of the specialized digital device 25, is fed to the group of inputs of the digital display unit 29 of the master judge's panel 28 and, through the interface 5, to the computer 6.

Following the arrival of a response signal from the group of outputs 27 of the interface 5 at the input of the specialized digital device 25, coinciding with the input 327 (FIG. 8) of the flip-flop 326, the latter is set to the opposite stable state. At this moment, signals 1 from the outputs 331 of the flip-flop 322, output 330 of the flip-flop 326 and output 333 of the distributor 314 are present at the inputs of the AND circuit 328. A signal from the output 335 of the AND circuit 328 triggers the delay element 337 through the OR circuit 334.

From the output 339 of the delay element 337, a signal delayed by a preset period of time is applied to the reset inputs of the flip-flops 302 and 268, to the input of the OR circuit 294 and to the input of the distributor 255. The flip-flops 302 and 268 as well as the distributor 255 are thus reset.

A signal from the output 339 of the delay element 337 is applied through the outputs $13_2$ and $41_2$ of the groups of outputs $13_1, \ldots, 13_n$ (FIG. 1) and $41_1, \ldots, 41_n$ to the inputs 98 (FIG. 2) of the flip-flops 96 of the judges' panels 1 (FIG. 1).

Applied to the input of the AND circuit 70 from the output 100 of the flip-flop 96 is an enable signal. Starting with this moment, the output signal of the resetting means 65 may pass through the OR circuit 67 and AND circuit 70 to the input 73 of the memory register 44, i.e. a judge may, at the request of the superior judge, cancel his mark and compose another.

A signal from the output 339 (FIG. 8) of the delay element 337 is applied through the outputs $15_2$ of the group of outputs $15_1, \ldots, 15_n$ (FIG. 1) of the processor 12 to the input 150 (FIG. 6) of the flip-flop 148 setting it to the opposite stable state. Another signal from the output 339 (FIG. 8) of the delay element 337 goes to the input of the delay element 340. From the output 341 of the delay element 340, a signal is applied with a preset delay to the input of the flip-flop 322 setting it to the opposite stable state, and to the input of the distributor 314 resetting it.

Should the superior judge be not satisfied with the judges' marks, he informs respective judges, after the marks have been printed on the digital printer 11 (FIG. 1), that the mark should be changed, through the intercommunication unit 22, intercommunication assembly 174 (FIG. 6) of the superior judge's panel 2 (FIG. 1) and intercommunication assemblies 118 (FIg. 2) of the judges' panels 1. The judges instructed by the superior judge to change their marks cancel the mark on a respective judge's panel 1 by pressing the push-button switch 66 (FIG. 2) of the resetting means 65.

At the output 54 of the resetting means 65 there appears a reset signal which is applied to the input 68 of the OR circuit 67. The reset signal passes through the OR circuit 67 and the AND circuit 70 unblanked at its input 71 to the input 73 of the memory register 44 and input 72 of the distributor 61. Thus, the memory register 44 and distributor 61 are reset.

Thereafter, the judges compose a new socre with the aid of the input device 48 of the panel 1, and enter this new score in the record in the same manner as in the case of transmission of the first mark.

At the same time, the superior judge enters the new score in the record by means of the record-keeping unit 145 of his panel 2 also in a manner similar to that when the first mark was entered. When new scores are entered in the record by respective judges using their panels 1 (FIG. 1) and the superior judge enters the new score on his panel 2 (FIG. 6), there begins processing of new information (marks, deductions) received from the judges' panels 1 (FIG. 1), on-line judges' panels 40 and stop watch 4, namely the average and final scores are automatically calculated. This process is similar to the one described above.

The superior judge evaluates, by locking at the digital display unit 165 (FIG. 6), the judges' marks as well as the average and final scores.

Should the superior judge approve the scores, he presses, on his panel 2 (FIg. 1), the push-button switch 170 (FIG. 6) of the command unit 169. A signal from the output 172 of the command unit 169 is applied through the input $16_3$ (FIG. 8) of the group of inputs $16_1, \ldots, 16_n$ (FIg. 1) of the processor 12 to the input of the flip-flop 323 (FIG. 8) setting it to the opposite stable state. A signal from the output 332 of the flip-flop 323 is applied through the OR circuit 324 to the inputs of the flip-flops 317 and 326 setting them to the opposite stable state.

The flip-flop 317 starts the pulse generator 315 controlling shifting of the distributor 314 and the digital printer 11 (FIG. 1). Information is successively fed from the gate units $296_4, \ldots, 296_{11}$ (FIG. 8) to the printer 11 (FIG. 1) in a manner like in the case of entering the scores in the record when the superior judge is not satisfied with the mark of a judge or judges.

From the output 325 (FIG. 8) of the OR circuit 324, a signal is applied through the output $26_1$ of the processor 12, coinciding with an output of the group of outputs $26_1, \ldots, 26_n$ (FIG. 1) of the specialized digital device 25, to the request input of the interface 5. At the same time, information from the outputs $26_2, \ldots, 26_7$ (FIG. 8) of the processor 12 (FIG. 1), coinciding with respective outputs of the group of outputs $26_1, \ldots, 26_n$ of the specialized digital device 25, is fed to the group of inputs of the digital display unit 29 of the master judge's panel 28, and through the interface 5, to the computer 6. At the moment the superior judge presses the push-button switch 170 (FIG. 6) of the command unit 169, a signal from the output 172 of the latter is applied through the input $16_3$ (FIG. 8) of the group of inputs $16_1, \ldots, 16_n$ (FIG. 1) of the processor 12 as well as through the OR circuit 344 and output $19_1$ of the group outputs $19_1, \ldots, 19_n$ (FIG. 1) of the processor 12 to the input of the flip-flop 372 (FIG. 11) of the luminous display unit 3 (FIG. 1) The flip-flop 372 (FIG. 11) is thus set to the opposite stable state. A signal from the output 374 of the flip-flop 372 sends the code of the final score from the outputs $19_2$ (FIG. 8) of the group of outputs $19_1, \ldots, 19_n$ (FIG. 1) of the processor 12 through the control input 298 (FIG. 10) of the gate unit 375'' (FIG. 11) to the inputs of the group of OR circuits $377_1, \ldots, 377_n$ (FIG. 11). A signal from the output 374 of the flip-flop 372 unblanks, via the OR circuit 370, the AND circuit 366 controlling the red lamps. The code of the final score is converted in the code converters $376_1, \ldots, 376_n$ into a code controlling the three-face luminous display board 345 whereon the final score is displayed with the aid of the luminous spots $346_{1-1}, \ldots, 346_{1-n}, \ldots, 346_{n-1}, \ldots, 346_{n-n}$.

The final score is flashed in red colour on the three-face luminous display board 345.

After a response signal from the group of outputs 27 (FIG. 1) of the interface 5 has arrived at the input of the specialized digital device 25, coinciding with the input 327 (FIG. 8) of the flip-flop 326, the AND circuit 329 is unblanked due to the fact that at the inputs of the AND circuit 329 there are present signals 1 coming from the outputs 332 of the flip-flop 323, outputs 330 of the flip-flop 326 and output 333 of the distributor 314.

From the output 336 of the AND circuit 329, a signal is applied to the input of the delay element 342. A signal from the output 343 of the delay element 342 passes through the outputs $13_3$, $41_3$, $15_3$ and $17_2$ of, respectively, the groups of outputs $13_1, \ldots, 13_n$ (FIG. 1), $41_1, \ldots, 41_n$, $15_1, \ldots, 15_n$ and $17_1, \ldots, 17_n$ of the processor 12 to the input 69 (FIG. 2) of the OR circuit 67, to the input 113 of the OR circuit 111 of the judges' panels 1 (FIG. 1) and on-line judges' panels 40, to the input 139 (FIG. 6) of the OR circuit 137 and input 163 of the OR circuit 161 of the superior judge's panel 2 (FIG. 1), and to the input 220 (FIG. 7) of the scorer's panel 9 (FIG. 1).

Reset as a result of this are the memory register 44 (FIG. 2), distributor 61, and counters 103 of the judges' panels 1 (FIG. 1) and on-line judges' panels 40, memory register 120 (FIG. 6), distributor 131, and counters 153 of the superior judge's panel 2 (FIG. 1), as well as memory register 176 (FIG. 7) and distributor 189 of the scorer's panel 9 (FIG. 1). From the output 222 (FIG. 7) of the OR circuit 218, a signal is applied through the group of outputs $10_1, \ldots, 10_n$ (FIG. 1) of the processor 12 to the interconnected inputs of the flip-flops 371 (FIG. 11) and 372 of the luminous display unit 3 (FIG. 1) and the latter is illuminated no more.

At the same time, a signal from the output 336 (FIG. 8) of the AND circuit 329 resets, through the AND circuit 334 and delay element 337, the flip-flops 268 and 302 as well as the distributor 265. Therewith, a signal from the output 339 of the delay element 337 resets, through the outputs $13_2$, $41_2$ and $15_2$ of, respectively, the groups of outputs $13_1, \ldots, 13_n$ (FIG. 1), $41_1, \ldots, 41_n$ and $15_1, \ldots, 15_n$ of the processor 12, the flip-flops 96 (FIG. 2) of the judges' panels 1 (FIG. 1) and on-line judges' panels 40 and the flip-flop 148 (FIG. 6) of the superior judge's panel 2 (FIG. 1).

A signal from the output 339 (FIG. 8) of the delay element 337 also resets, via the delay element 340, the flip-flop 323 and distributor 314.

Thus, the specialized digital device 25 (FIG. 1) is brought back to the initial state and the judges of a particular event of an all-around competition may start evaluating the exercise executed by the next competitor.

The specialized digital device 25 also permits the final score to be entered directly on the scorer's panel 9. To do this, the scorer presses the push-button switch 196 (FIG. 7) of the command unit 194 on his panel 9. A signal from the output 201 of the command unit 194 is applied to the information entry input of the memory register 177. Then, by successively pressing the push-button switches 185 of the input device 184, the scorer enters the final score in the memory register 177. The score is entered just like the competitor's number was entered in the memory register 176. The code of the final score from the outputs 233 of the memory register 177 is fed via the inputs $18_1$ (FIG. 8) of the group of inputs $18_1, \ldots, 18_n$ (FIG. 1) of the processor 12 to the inputs of the gate unit $296_2$ (FIG. 8). As a signal 1 arrives from the output of the flip-flop 302 at the input 298 (FIG. 10) of the gate unit $296_2$ (FIG. 8), the code of the final score is delivered from the outputs $300_1, \ldots, 300_n$ (FIG. 10) of the gate unit $296_2$ to the inputs of the group of OR circuits 301. From the outputs $313_1, \ldots, 313_n$ of the group of OR circuits 301, the code of the final score is further fed, through the outputs $17_3$ of the group of outputs $17_1, \ldots, 17_n$ (FIG. 1) of the processor 12, to the group of inputs 231 (FIG. 7) of the digital display unit 230 of the scorer's panel 9 (FIG. 1).

To display the final score on the luminous display unit 3, the scorer presses the push-button switch 197 (FIG. 7) of the command unit 194 of his panel 9 (FIG. 1). A signal from the output 204 (FIG. 7) of the command unit 194 is applied through the AND circuit 203 and input $18_3$ (FIG. 8) of the group of inputs $18_1, \ldots, 18_n$ (FIG. 1) of the processor 12 and through the OR circuit 344 (FIG. 8) from the output $19_1$ of the group of outputs $19_1, \ldots, 19_n$ (FIG. 1) of the processor 12 to the input of the flip-flop 372 (FIG. 11) of the luminous display unit 3 (FIG. 1).

The process of switching on the luminous display unit 3 for displaying the final score on the three-face luminous display board 345 (FIG. 11) is similar to that of switching it on when the final score is automatically put out of the processor 12 (FIG. 1).

Each of the specialized digital devices 25 for other events of an all-around competition operates in a similar fashion.

The master judge of the competition may have the intercommunication unit 30 of his panel 28 connected through the intercommunication lines 31 to the intercommunication unit 22 of each specialized device 25.

He may also have the intercommunication unit 30 of his panel 28 linked through the intercommunication line 36 with the intercommunication unit 33 of the dispatcher's panel 32.

The dispatcher, in turn, may have his intercommunication unit 33 linked through the intercommunication line 38 with the technical service posts 39 in the gymnasium.

The electronic computer 6 collects the current information from all specialized digital devices 25 and, in accordance with a preset program taking into account all aspects of the organization of the competition, processes all the records and scores and controls the output of all the relevant information to the luminous display board 7 and printer 11.

The automatic information system of the present invention relieves the judges, especially the superior judge who supervises the entire jury of a particular event of an all-around gymnastic competition, from all functions which distract their attention from evaluating a gymanast's performance. The proposed system is practically error-free as far as the calculation of the average and final scores is concerned. The possibility of the judges to intercommunicate through the intercom system which is switched off while a competitor executes an exercise, the appearance of the judges' marks on the superior judge's display board only after he has composed his own score, and enterring the scores in the record after they have been sent to the superior judge render judging more objective and accurate.

What is claimed is:

1. An automatic information system for the organization of gymnastic competitions, intended to collect and process the individual scores awarded by the judges to each competitor, to facilitate and accelerate the judging procedure, to keep the record and score, as well as to provide for visual display of the current and final results of a competition and to send this information to a computer (6) controlling a luminous score board (7), comprising, for each event of an all-around gymnastic competition, judges' panels (1) and a superior judge's panel (2) intended for manual input of scores for individual exercises of a competitor, a luminous display unit (3) for displaying the number of the competitor and the points he or she has socred, and, for two events, namely, beam and floor exercises, a stop watch (4) for determining the duration of an exercise as performed by a competitor and the amount of points to be deducted, whereby the competitor and judges are informed as to the time competitor has spent so far and deductions are automatically made for exceeding the prescribed time limit; an interface (5) intended for feeding the information provided by the judges into said computer (6) and connected to said computer (6) controlling said luminous score board (7) and having its output connected to a printer; a scorer's panel (9) intended for the input and storage of the competitor's number and his or her final score and connected to said luminous display unit (3); a group of outputs ($10_1, \ldots, 10_n$) of said scorer's panel (9); a digital printer (11) for printing the record and score for each competitor; a processor (12) intended to calculate the average and final scores awarded to a competitor, to store the current information on the progress of the competition, and to send it to said interface (5) to control said judges' panels (1), superior judge's panel (2) and scorer's panel (9), said luminous display unit (3), said digital printer (11), the processor being connected to all said units, and, for events, namely, beam and floor exercises, to said stop watch (4); groups of inputs ($14_1, \ldots, 14_n$; $16_1, \ldots, 16_n$; $18_1, \ldots, 18_n$; $21_1, \ldots, 21_n$; $42_1, \ldots, 42_n$) of said processor (12); groups of outputs ($13_1, \ldots, 13_n$; $15_1, \ldots, 15_n$; $17_1, \ldots, 17_n$; $19_1, \ldots, 19_n$; $20_1, \ldots, 20_n$, $41_1, \ldots, 41_n$) of said processor (12); an intercommunication unit (22) which is switched off while a competitor is executing an exercise; intercommunication lines (24); said intercommunication unit (22) being linked, through said intercommunication lines (24) with said judges's panel (1) and superior judge's panel (2); said judges' panels (1), superior judge's panel (2), scorer's panel (9), processor (12), luminous display unit (3), printer (11) and intercommunication unit (22), in each event of an all-around gymnastic competition, as well as said stop watch (4), in two events, namely, beam and floor exercises, making up a specialized digital device (25) intended to collect subjective initial information on an individual competitor from the judges of a particular event of the all-around competition, to process this information, to display the score of each competitor on the luminous score board (7), and to keep the record and score for each competitor, each of said digital devices being connected to said interface (5); a master judge's panel (28) providing for intercommunication with the judges of all events of the all-around gymnastic competition for displaying digital information from each said specialized digital device (25); and a dispatcher's panel (32) through which the dispatcher calls individual competitors in all events of the all-around gymnastic competitor, said dispatcher's panel being connected to all said specialized digital devices (25) and ensuring intercommunication with said master judge's panel (28), scorer panels (9) and technical service posts (39) in the gymnasium.

2. A system as claimed in claim 1, wherein said specialized digital device (25) additionally comprises, in one event of an all-around gymnastic competition, namely, floor exercises, two on-line judges' panels (40) intended for the input of a deduction for stepping out of the floor exercise area, said panels being connected to said processor (12) and intercommunication unit (22).

3. A system as claimed in claim 1, wherein each said judge's panel (1) comprises: a memory register (44) for storing the score awarded to a competitor, said memory register (44) having inputs (57), digit select inputs (64), a reset input (73) and outputs (117); a manual score input device (48); a coder (56) connected to said manual score input device (48) and to said inputs (57) of said memory register (44), said coder (56) having inputs and outputs; a first OR circuit (58) having inputs (59) and an output; said inputs (59) of said first OR circuit (58) being connected to said outputs of said coder (56); a second OR circuit (60) having inputs and an output; a distributor (61) having an input (62), a reset input (72) and outputs (63); said input (62) of said distributor (61) being connected to said output of said first OR circuit (58); said outputs (63) of said distributor (61) being connected to said inputs of said second OR circuit (60) and to said digital select inputs (64) of said memory register (44); a means (65) for resetting said memory register (44), having an output; a third OR circuit (67) having inputs (68, 69) and an output; one of said inputs (68) of said third OR circuit (67) being connected to said output of said means (65) for resetting said memory register (44); other said input (69) of said third OR circuit (67) being connected to said group of outputs ($13_1, \ldots, 13_n$) of said processor (12); a first AND circuit (70) having input and an output; one of said inputs (71) of said first AND circuit (70) being connected to said output of said third OR circuit (67); said output of said first AND circuit (70) being connected to said reset input (72) of said distributor (61) and to said reset input (73) of said memory register (44); a second AND circuit (74) having inputs and an output; a record-keeping unit (75) intended for writing down the score of a competitor on a moving paper tape and having an output (88); and output (88) of said record-keeping unit (75) being connected to one of said inputs of said second AND circuit (74); other said input (89) of said second AND circuit (74) being connected to said output of said second OR circuit (60); an indication unit (90) having an input (102); a third AND circuit (91) having inputs and an output; a flip-flop (96) having inputs (97, 98) and outputs (99, 100); said first input (97) of said flip-flop (96) being connected to said output of said second AND circuit (74); said second input (98) of said flip-flop (96) being connected to said group of outputs ($13_1, \ldots, 13_n$) of said processor (12); said first output (99) of said flip-flop (96) being connected to said group of inputs ($14_1, \ldots, 14_n$) of said processor (12); said second output (100) of said flip-flop (96) being connected to said second input of said first AND circuit (70) and to said first input of said third AND circuit (91); said second input (101) of said third AND circuit (91) being connected to said group of outputs ($13_1, \ldots, 13_n$) of said processor (12); said output of said third AND circuit (91) being connected to said indication unit (90); counters (103) for registering elements of individual parts of exercises, characterized by different degrees of difficulty, and faults in the execution of these exercises, siad counters (103) having inputs, reset inputs (114) and outputs; data input units (104) having outputs; each of said data input units (104) being connected to a respective said counter (103); a means (106) for resetting said counters (103), having an output (109); a fourth AND circuit (108) having inputs and an output; one of said inputs of said fourth AND circuit (108) being connected to said output of said means (106), for resetting said counters (103); the other one of said inputs (110) of said fourth AND circuit (108) being connected to said output (100) of said flip-flop (96); a fourth OR circuit (111) having inputs (112, 113) and an output; one of said inputs (112) of said fourth OR circuit (111) being connected to said output of said fourth AND circuit (108); the other one of said inputs (113) of said fourth OR circuit (111) being connected to said group of outputs ($13_1, \ldots, 13_n$) of said processor (12); said output of said fourth OR circuit (111) being connected to said reset inputs (114) of said counters (103); a digital display unit (115) having a first and a second groups of inputs; said first group of inputs (116) of said digital display unit (115) being connected to said outputs of said counters (103); said second group of inputs of said digital display unit (115) being connected to respective said outputs (117) of said memory register (44), said outputs (117) being connected to said group of inputs ($14_1, \ldots, 14_n$) of said processor (12); and an intercommunication assembly (118) linked with said intercommunication unit (22) through said intercommunication line (24).

4. A system as claimed in claim 1, wherein said superior judge's panel (2) comprises: a memory register (120) for storing the score awarded to a competitor, said memory register (120) having inputs (127), digit select inputs (134), a reset input (143) and outputs (167); a manual score input device (124); a coder (126) connected to said manual score input device (124) and to said inputs (127) of said memory register (120), said coder (126) having inputs and outputs; a distributor (131) intended for digitwise entry of a competitor's score in said memory register (120), having an input (132), a reset input (142) and outputs (133); a first OR circuit (128) for starting said distributor (131), having inputs (129) and an output; said inputs (129) of said first OR circuit (128) being connected to said outputs of said coder (126); a second OR circuit (130) having inputs and an output; said input (132) of said distributor (131) being connected to said output of said first OR circuit (128); said outputs (133) of said distributor (131) being connected to said inputs of said second OR circuit (130) and to said digit select inputs (134) of said memory register (120); a means (135) for resetting said memory register (120), having an output; a third OR circuit (137) having inputs (138, 139) and an output; one of said inputs (138) of said third OR circuit (137) being connected to said output of said means (135) for resetting said memory register (120); the other one of said inputs (139) of said third OR circuit (137) being connected to said group of outputs ($15_1, \ldots, 15_n$) of said processor (12); a first AND circuit (140) having inputs and an output; one of said inputs of said first AND circuit (140) being connected to said output of said third OR circuits (137); said output of said first AND circuit (140) being connected to said reset input (142) of said distributor (131) and to said reset input (143) of said memory register (120); a second AND circuit (144) having inputs and an output; a record-keeping unit (145) intended for writing down the score of a competitor on a moving paper tape (79), having an output; said output of said record-keeping unit (145) being connected to one of said inputs of said second AND circuit (144); the other one of said inputs (147) of said second AND circuit (144) being connected to said output of said second OR circuit (130); a flip-flop (148) having inputs (149, 150) and outputs (151, 152); said first input (149) of said flip-flop (148) being connected to said output of said second AND circuit 144); said second input (150) of said flip-flop (148) being connected to said group of outputs ($15_1, \ldots, 15_n$) of said processor (12); said first output (151) of said flip-flop (148) being connected to said group of inputs ($16_1, \ldots, 16_n$) of said processor (12); said second output (152) of said flip-flop (148) being connected to said second input of said first AND circuit (140); counters (153) for registering elements of individual parts of exercises, characterized by different degrees of difficulty, and faults in the execution of the exercises, said counters (153) having inputs, reset inputs (164) and outputs; data input devices (154) having outputs; each of said data input devices (154) being connected to a respective said counter (153); a means (156) for resetting said counters (153), having an output (159); a third AND circuit (158) having inputs and an output; one of said inputs of said third AND circuit (158) being connected to said means (156) for resetting said counters (153); the other one of said inputs (160) of said third AND circuit (158) being connected to said second output (152) of said flip-flop (148); a fourth OR circuit (161) having inputs (162, 163) and an output; one of said inputs (162) of said fourth OR circuit (161) being connected to said output of said third AND circuit (158); the other one of said inputs (163) of said fourth OR circuit (161) being connected to said group of outputs ($13_1, \ldots, 13_n$) of said processor (12); said output of said fourth OR circuit (161) being connected to said reset inputs (164) of said counters (153); a digital display unit (165) having groups of inputs; the first one of said groups of inputs (166) of said digital display unit (165) being connected to said outputs of said counters (153); the second one of said groups of inputs of said digital display unit (165) being connected to respective said outputs (167) of said memory register (120), also connected to said group of inputs ($16_1, \ldots, 16_n$) of said processor (12); the third one of said groups of inputs (168) of said digital display unit (165) being connected to said group of outputs ($15_1, \ldots, 15_n$) of said processor (12); a command unit (169) having outputs (172, 173); said outputs of said command unit (169) being connected to said group of inputs ($16_1, \ldots, 16_n$) of said processor (12); and an intercommunication assembly (174) linked with said intercommunication unit (22) through said intercommunication line (24).

5. A system as claimed in claim 1, wherein said scorer's panel (9) comprises; a memory register (176) for storing the number of a competitor, having inputs (187), data entry permit inputs, digit select inputs and outputs (232); a memory register (177) for storing the final score awarded to a competitor for executing an exercise, having inputs (188), digit select inputs, data entry permit inputs and outputs (233); a device (184) for manual entry of information in said memory registers (176, 177), having outputs; a coder (186) connected to said device (184) and to said inputs (187, 188) of said memory registers (176, 177); a distributor (189) intended for digitwise entry of information in said memory registers (176, 177), said distributor (189) having an input, a reset input and outputs (193); a first OR circuit (190) for starting said distributor (189), having inputs (191) and an output (192); said inputs (191) of said first OR circuit (190) being connected to outputs of said coder (186); said output (192) of said first OR circuit (190) being connected to said input of said distributor (189); said outputs (193) of said distributor (189) being connected to said digit select inputs of said memory registers (176, 177); a command unit (194) intended for the selection of a respective memory register for data input and for controlling said luminous display unit (3), said command units (194) having outputs (200, 201, 204, 224, 226); the first and second ones of said outputs (200, 201) of said command unit (194) being connected to said data entry permit inputs of a respective memory register (176 or 177); a first AND circuit (202) having inputs and an output (205); a second AND circuit (203) having inputs and an output (206); the first ones of said inputs of said first and second AND circuits (202, 203) being interconnected and coupled to said third output (204) of said command unit (194); the second ones of said inputs of said first and second AND circuits (202, 203) being connected to said first and second outputs (200, 201), respectively, of said command unit (194); said output (205) of said first AND circuit (202) being connected to said group of inputs of said luminous display unit (3); said output (206) of said second AND circuit (203) being connected to said group of inputs ($18_1, \ldots, 18_n$) of said processor (12); a means (207) for resetting said memory registers (176, 177), having an output; a third AND circuit (209) having inputs and an output (213); a fourth AND circuit (210) having inputs and an output (214); the first ones of said inputs of said third and fourth AND circuits (209, 210) being interconnected and coupled to said means (207) for resetting said memory registers (176, 177); the second ones of said inputs of said third and fourth AND circuits (209, 210) being connected to said first and second outputs (200, 201), respectively, of said command unit (194); a second OR circuit (211) having inputs and an output (215); a third OR circuit (212) having inputs and an output (216); the first ones of said inputs of said second and third OR circuit (211, 212) being connected to said outputs (213, 214), respectively, of said third and fourth AND circuits (209, 210); said outputs (215, 216) of said second and third OR circuits (211, 212) being connected to said reset inputs of said memory registers (176, 177), respectively; a flip-flop (217) for selecting the colour of the information being displayed on said luminous display unit (3), having inputs and outputs (227, 228); a fourth OR circuit (218) having inputs and an output (222); the first one of said inputs (219) of said fourth OR circuit (218) being connected to said output of said means (207) for resetting said memory registers (176, 177); the second one of said inputs of said fourth OR circuit (218) being interconnected with said second inputs of said second and third OR circuits (211, 212) and coupled to said group of outputs ($17_1, \ldots, 17_n$) of said processor (12); said output (222) of said fourth OR circuit (218) being connected to said reset input of said distributor (189) and to said group of inputs of said luminous display unit (3); a fifth OR circuit (223) having inputs and an output (225); the first one of said inputs of said fifth OR circuit (223) being connected to siad ouput (222) of said fourth OR circuit (218); the second one of said inputs of said fifth OR circuit (223) being connected to said fourth output (224) of said command unit (194); said output (225) of said fifth OR circuit (223) being connected to the second one of said inputs of said flip-flop (217); the first one of said inputs of said flip-flop (217) being connected to said fifth output (226) of said command unit (194); both said outputs (227, 228) of said flip-flop (217) being connected to a respective said group of inputs of said luminous display unit (3); said third input (229) of said first AND circuit (202) being interconnected with the third one of said inputs of said fifth OR circuit (223) and coupled to said group of outputs (27) of said dispatcher's panel (32); a digital display unit (230) having groups of inputs; the first one of said groups of inputs (231) of said digital display unit (230) being connected to said group of outputs ($17_1$, . . . , $17_n$) of said processor (12); the second one of said group of inputs of said digital display unit (230) being connected to said outputs (232) of said memory register (176) for storing the number of a competitor, which outputs (232) are also connected to said group of inputs of said luminous display unit (3) and to said group of inputs ($18_1$, . . . , $18_n$) of said processor (12); said outputs (233) of said memory register (177) for storing the final score of a competitor for executing an exercise being connected to said group of inputs ($18_1$, . . . , $18_n$) of said processor (12); an intercommunication assembly (234); intercommunication lines (37); said intercommunication assembly (234) being linked with said dispatcher's panel (32) through said intercommunication lines (37).

6. A system as claimed in claim 1, wherein said processor (12) of said specialized digital device (25) comprises: a binary counter (235) having an input, reset inputs and outputs; an adder (236) having inputs and outputs (311); comparison circuits ($237_1$, . . . , $237_i$, $237_k$, $237_n$) intended to compare the information from said binary counter (235) with the information from said judges' panels (1) and said stop watch (4) for determining the duration of an exercise as performed by a competitor, said comparison circuits ($237_1$, . . . , $237_i$, $237_k$, $237_n$) having inputs ($253_1$, . . . , $253_i$, $253_k$, $253_n$; $249_1$, . . . , $249_i$, $249_k$, $249_n$), control inputs ($243_1$, . . . , $243_i$, $243_k$, $243_n$) and outputs ($239_1$, . . . , $239_i$, $239_k$, $239_n$); the first ones of said inputs ($249_1$, . . . , $249_i$, $249_k$ , $249_n$) of said comparison circuits ($237_1$, . . . , $237_i$, $237_k$, $237_n$) being interconnected digitwise and coupled to respective said outputs of said binary counter (235); the second ones of said inputs ($253_1$, . . . , $253_i$, $253_k$, $253_n$) of said comparison circuits ($237_1$, . . . , $237_i$, $237_k$, $237_n$) being connected to, respectively, said outputs of said judges' panels (1), said stop watch (4) and said adder (236); a first distributor (255) having an input, a reset input and outputs; the first one of said outputs of said first distributor (255) being connected to said control inputs ($243_1$, . . . , $243_i$) of said comparison circuits ($237_1$, . . . , $237_i$), which control inputs ($243_1$, . . . , $243_i$) are connected to said judges' panels (1); the second one of said outputs of said first distributor (255) being connected to said control input ($243_k$) of said comparison circuit ($237_k$) which is connected to said stop watch (4); the third one of said outputs of said first distributor (255) being connected to said control input ($243_n$) of said comparison circuit ($237_n$) which is connected to said adder (236); a first OR circuit (256) having inputs and outputs; said inputs of said first OR circuit (256) being connected to said outputs ($239_1$, . . . , $239_i$, $239_k$, $239_n$) of said comparison circuits ($237_1$, . . . , $237_i$, $237_k$, $237_n$), which are connected to said judges' panels (1); a second distributor (257) having an input (258), a reset input and outputs; said input (258) of said second distributor (257) being connected to said output of said first OR circuit (256); a first flip-flop (259) having a count input and an output (282); a second flip-flop (260) having inputs and outputs (280, 281); the first one of said inputs (261) of said second flip-flop (260) being connected to the first one of said outputs of said second distributor (257); a first pulse generator (262) having an input and an output (263); said output (263) of said first pulse generator (262) being connected to said input of said binary counter (235) and to said count input of said first flip-flop (259); a first delay element (264) having an input (267) and an output (265); a second OR circuit (266) having inputs and an output; said output of said second OR circuit (266) being connected to said first delay element (264); the first one of said inputs of said second OR circuit (266) being connected to said output ($239_k$) of said comparison circuit ($237_k$) coupled to said stop watch (4); the second one of said inputs of said second OR circuit (266) being connected to said output ($239_n$) of said comparison circuit ($237_n$) coupled to said adder (236); a third flip-flop (268) having inputs and an output; a reversible binary counter (269) having an input (275), a control input (270), a reset input and outputs (272); said control input (270) of said reversible binary counter (269) being connected to said output of said third flip-flop (268); a memory register (271) having inputs, a reset input and outputs (312); said inputs of said memory register (271) being connected to said outputs (272) of said reversible binary counter (269); the second one of said outputs (273) of said second distributor (257) being connected to the first one of said inputs of said flip-flop (268), to one of said inputs of said memory register (271) and to the third one of said inputs of said second OR circuit (266); a third OR circuit (274) having inputs and outputs; one of said outputs of said third OR circuit (274) being connected to said input (275) of said reversible binary counter (269); a first AND circuit (276) having inputs and an output (278); a second AND circuit (277) having inputs and an output (279); said outputs (278, 279) of said first and second AND circuits (276, 277) being connected to said inputs of said third OR circuit (274); the first ones of said inputs of said first and second AND circuits (276, 277) being connected to respective said outputs (280, 281) of said second flip-flop (260); the second one of said inputs of said first AND circuit (276) being connected to said output (263) of said first pulse generator (262); the second one of said inputs of said second AND circuit (277) being connected to said output (282) of said first flip-flop (259); a fourth flip-flop (283) having inputs and an output (284); said output (284) of said fourth flip-flop (283) being connected to said input of said first pulse generator (262); a second delay element (285) having an input (288) and an output (286); said output (286) of said second delay element (285) being connected to the first one of said inputs of said fourth flip-flop (283); a fourth OR circuit (287) having inputs and an output; said output of said fourth OR circuit (287) being connected to said input (288) of said second delay element (285); one of said inputs of said fourth OR circuit (287) being connected to the second one of said outputs (273) of said second distributor (257); a third AND circuit (289) having inputs and an output; a fourth AND circuit (290) having inputs and an output; said outputs of said third and fourth AND circuits (289, 290) being connected to said inputs (291) of said fourth OR circuit (287); the first one of said inputs (292) of said third AND circuit (289) being connected to the first one of said outputs of said first distributor (255); each of the remaining ones of said inputs of said third AND circuit (289) being connected to said output of a respective said judge's panel (1); the first one of said inputs (293) of said fourth AND circuit (290) being connected to the third one of said outputs of said first distributor (255); the second and third ones of said inputs of said fourth AND circuit (290) being connected to said outputs of respective said on-line judges' panels (40); a fifth OR circuit (294) having inputs and an output (295); one of said inputs of said fifth OR circuit (294) being connected to said output (265) of said first delay element (264); said output (295) of said fifth OR circuit (294) being connected to the second ones of said inputs of said second and fourth flip-flops (260, 283), to said reset inputs of said binary counter (235) and said second distributor (257); a first gate unit ($296_1$) having a group of inputs ($299_1, \ldots, 299_n$), a control input (298) and a group of outputs ($300_1, \ldots, 300_n$); said group of inputs ($299_1, \ldots, 299_n$) of said first gate unit ($296_1$) being connected to respective said outputs (272) of said reversible binary counter (269); a group of OR circuits (301) having inputs and outputs; the first ones of said inputs of said group of OR circuits (301) being connected to said group of outputs ($300_1, \ldots, 300_n$) of said first gate unit ($296_1$); a second gate unit ($296_2$) having inputs ($299_1, \ldots, 299_n$), a control input (298) and outputs ($300_1, \ldots, 300_n$); said inputs ($299_1, \ldots, 299_n$) of said second gate unit ($296_2$) being connected to said outputs of said memory register (177) for storing the final score from scorer's panel (9); said outputs ($300_1, \ldots, 300_n$) of said second gate unit ($296_2$) being connected to the second ones of said inputs of said group of OR circuits (301); a fifth flip-flop (302) having inputs and outputs; said outputs of said fifth flip-flop (302) being connected to, respectively, said control units (298) of said first and second gate units ($296_1$, $296_2$); the first one of said inputs of said fifth flip-flop (302) being connected to said output ($239_n$) of said comparison circuit ($237_n$) coupled to said adder (236) and to one of said outputs ($17_1$) of said processor (12); a programming unit (303) having outputs; a coder (305) having inputs (306) and outputs (310); said inputs (306) of said coder (305) being connected to said outputs of said programming unit (303); a second pulse generator (307) having an output; a fifth AND circuit (308) having inputs and an output; one of said inputs (309) of said fifth AND circuit (308) being connected to said output of said second pulse generator (307); said output of said fifth AND circuit (308) being connected to said inputs of said judge's panels (1) and on-line judges' panels (40); third gate units ($296_{3-1}, \ldots, 296_{3-i}$) having inputs ($299_1, \ldots, 299_n$), control inputs (298) and inputs ($300_1, \ldots, 300_n$); said inputs ($299_1, \ldots, 299_n$) of said third gate units ($296_{3-1}, \ldots, 296_{3-i}$) being connected to said outputs of respective said judges' panels (1);

said control inputs (298) of said third gate units ($296_{3-1}, \ldots, 296_{3-i}$) being connected to the other one of said inputs of said fifth AND circuit (308) and to a respective one of said outputs of said superior judge's panel (2); said outputs ($300_1, \ldots, 300_n$) of said first gate unit ($296_1$), said outputs (312) of said memory register (271) and said outputs ($300_1, \ldots, 300_n$) of said third gate units ($296_{3-1}, \ldots, 296_{3-i}$) being connected to respective said inputs of said third group of inputs (168) of said digital display unit (165) of said superior judge's panel (2); a fourth gate unit ($296_4$) having inputs ($299_1, \ldots, 299_n$), a control input (298) and outputs ($300_1, \ldots, 300_n$); said inputs ($299_1, \ldots, 299_n$) of said fourth gate unit ($296_4$) being connected to said outputs of said superior judge's panel (2); a fifth gate unit ($296_5$) having inputs ($299_1, \ldots, 299_n$), a control input (298) and outputs ($300_1, \ldots, 300_n$); said inputs ($299_1, \ldots, 299_n$) of said fifth gate unit ($296_5$) being connected to said outputs of said scorer's panel (9); a sixth gate unit ($296_6$) having inputs ($299_1, \ldots, 299_n$), a control input (298) and outputs ($300_1, \ldots, 300_n$); said inputs ($299_1, \ldots, 299_n$) of said sixth gate unit ($296_6$) being connected to said outputs (310) of said coder (305); seventh gate units ($296_{7-1}, \ldots, 296_{7-i}$) having inputs ($299_1, \ldots, 299_n$), control inputs (298) and outputs ($300_1, \ldots, 300_n$); said inputs ($299_1, \ldots, 299_n$) of said seventh gate units ($296_{7-1}, \ldots, 296_{7-i}$) being connected to said outputs of said judges' panels (1); an eighth gate unit ($296_8$) having inputs ($299_1, \ldots, 299_n$) a control unit (298) and outputs ($299_1, \ldots, 299_n$), a control unit (298) and output ($300_1, \ldots, 300_n$); said inputs ($299_1, \ldots, 299_n$) of said eighth gate unit ($296_8$) being connected to said outputs of said stop watch (4); a ninth gate unit ($296_9$) having inputs ($299_1, \ldots, 299_n$), a control input (298) and outputs ($300_1, \ldots, 300_n$); said inputs ($299_1, \ldots, 299_n$) of said ninth gate unit ($296_9$) being connected to said outputs (311) of said adder (236); a tenth gate unit $296_{10}$) having inputs ($299_1, \ldots, 299_n$), a control input (298) and outputs ($300_1, \ldots, 300_n$); said inputs ($299_1, \ldots, 299_n$) of said tenth gate unit ($296_{10}$) being connected to said outputs (312) of said memory register (271); an eleventh gate unit ($296_{11}$) having inputs ($299_1, \ldots, 299_n$), a control input (298) and outputs ($300_1, \ldots, 300_n$); said inputs ($299_1, \ldots, 299_n$) of said eleventh gate unit ($296_{11}$) being connected to said outputs ($313_1, \ldots, 313_n$) of said group of OR circuits (301); a third distributor (314) having an input, a reset input and outputs; said outputs of said third distributor (314) being connected, respectively, to said control inputs (298) of said fourth, fifth, sixth, seventh, eighth, ninth, tenth and eleventh gate units ($296_4$ to $296_{11}$); a third generator (315) having an input and an output (316); said output (316) of said third pulse generator (315) being connected to said input of said third distributor (314) and to said input of said digital printer (11); a sixth flip-flop (317) having inputs and an output (318); said output (318) of said sixth flip-flop (317) being connected to said input of said third pulse generator (315); a second group of OR circuits (319) having inputs and outputs; said inputs of said second group of OR circuits (319) being connected to respective said outputs ($300_1, \ldots, 300_n$) of said fourth, fifth, sixth, seventh, eighth, ninth, tenth and eleventh gate units ($296_4$ to $296_{11}$); a code converter (320) having inputs (321) and outputs; said inputs (321) of said code converter (320) being connected to said outputs of said second group of OR circuits (319); said outputs of said code converter (320) being connected to said inputs of said digital printer (11); a seventh flip-flop (322) having inputs and an output (331); an eighth flip-flop (323) having inputs and an output (332); the first ones of said inputs of said seventh and eighth flip-flops (322, 323) being connected to respective said outputs of said superior judge's panel (2); a sixth OR circuit (324) having inputs and an output (325); said output (325) of said sixth OR circuit (324) being connected to the first one of said inputs of said sixth flip-flop (317) and to said input of said interface (5); a ninth flip-flop (326)

having inputs and an output (330); the first one of said inputs of said ninth flip-flop (326) being connected to said output (325) of said sixth OR circuit (324); the second one of said inputs (327) of said ninth flip-flop (326) being connected to said input of said interface (5); a sixth AND circuit (328) having inputs and an output (335); a seventh ANd circuit (329) having inputs and an output (336); the first ones of said inputs of said sixth and seventh AND circuits (328, 329) being connected to said output (330) of said ninth flip-flop (326); said outputs (331, 332) of said seventh and eighth flip-flops (322, 323) being connected to said inputs of said sixth OR circuit (324) and to the second ones of said inputs of said sixth and seventh AND circuits (328, 329);

one of said outputs (333) of said third distributor (314) being connected to the second one of said inputs of said sixth flip-flop (317) and to the third ones of said inputs of said sixth and seventh AND circuits (328,329); a seventh OR circuit (334) having inputs and an output (338); said inputs of said seventh OR circuit (334) being connected to said outputs (335, 336) of said sixth and seventh AND circuits (328, 329); a third delay element (337) having an input and an output (339); said input of said third delay element (337) being connected to said output (338) of said seventh OR circuit (334); said output (339) of said third delay element (337) being connected to the second one of said inputs of said fifth flip-flop (302) and to said reset inputs of said memory register (271), said reversible binary counter (269) and said first distributor (255), as well as to the second one of said inputs of said third flip-flop (268), to the second one of said inputs of said fifth OR circuit (294) and to said inputs of said judges' panels (1) and on-line judges' panels (40); a fourth delay element (340) having an input and an output (341); said input of said fourth delay element (340) being connected to said output (339) of said third delay element (337); said output (341) of said fourth delay element (340) being connected to said reset input of said third distributor (314) and to the second ones of said inputs of said seventh and eighth flip-flops (322, 323); a fifth delay element (342) having an input and an output (343); said input of said fifth delay element (342) being connected to said output (336) of said seventh AND circuit (329); said output (343) of said fifth delay element (342) being connected to said inputs of said judges' panels (1), on-line judges' panels (40), superior judge's panel (2) and scorer's panel (9); an eighth OR circuit (344) having inputs and an output; the first one of said inputs of said eighth OR circuit (344) being connected to said output of said superior judge's panel (2); the second one of said inputs of said eighth OR circuit (344) being connected to said output of said scorer's panel (9); said output of said eighth OR circuit (344) being connected to said input of said luminous display unit (3).

7. A system as claimed in claim 2, wherein said processor (12) of said specialized digital device (25) comprises: a binary counter (235) having an input, a reset input and outputs; an adder (236) having inputs and outputs (311); comparison circuits ($237_1, \ldots, 237_i, 237_k, 237_n$) intended to compare the information from said binary counter (235) with the information from said judges' panels (1) and said stop watch (4) for determining the duration of an exercise as performed by a competitor, said comparison circuits ($237_1, \ldots, 237_i, 237_k, 237_n$) having inputs ($253_1, \ldots, 253_i, 253_k, 253_n$; $249_1, \ldots, 249_i, 249_k, 249_n$), control inputs ($243_1, \ldots, 243_i, 243_k, 243_n$) and outputs ($239_1, \ldots, 239_i, 239_k, 239_n$); the first ones of said inputs ($249_1, \ldots, 249_i, 249_k, 249_n$) of said comparison circuits ($237_1, \ldots, 237_i, 237_k, 237_n$) being interconnected digitwise and coupled to respective said outputs of said binary counter (235); the second ones of said inputs ($253_1, \ldots, 253_i, 253_k, 253_n$) of said comparison circuits ($237_1, \ldots, 237_i, 237_k, 237_n$) being connected, respectively, to said outputs of said judges' panels (1), said stop watch (4) and said adder (236); said inputs of said adder (236) being connected to said on-line judges' panels (40); a first distributor (255) having an input, a reset input and outputs; the first one of said outputs of said first distributor (255) being connected to said control inputs ($243_1, \ldots, 243_i$) of said comparison circuits ($237_1, \ldots, 237_i$), which control inputs ($243_1, \ldots, 243_i$) are connected to said judges' panels (1); the second one of said outputs of said first distributor (255) being connected to said control input ($243_k$) of said comparison circuit ($237_k$) which is connected to said stop watch (4); the third one of said outputs of said first distributor (255) being connected to said control input ($243_n$) of said comparison circuit ($237_n$) which is connected to said adder (236); a first OR circuit (256) having inputs and outputs; said inputs of said first OR circuit (256) being connected to said outputs ($239_1, \ldots, 239_i, 239_k, 239_n$) of said comparison circuits ($237_1, \ldots, 237_i, 237_k, 237_n$), which are connected to said judges' panels (1); a second distributor (257) having an input (258), a reset input and outputs; said input (258) of said second distributor (257) being connected to said output of said first OR circuit (256); a first flip-flop (259) having a count input and an output (282); a second flip-flop (260) having inputs and outputs (280, 281); the first one of said inputs (261) of said second flip-flop (260) being connected to the first one of said outputs of said second distributor (257); a first pulse generator (262) having an input and an output (263); said output (263) of said first pulse generator (262) being connected to said input of said binary counter (235) and to said count input of said first flip-flop (259); a first delay element (264) having an input (267) and and output (265); a second OR circuit (266) having inputs and an output; said output of said second OR circuit (266) being connected to said first delay element (264); the first one of said inputs of said second OR circuit (266) being connected to said output ($239_k$) of said comparison circuit ($237_k$) coupled to said stop watch (4); the second one of said inputs of said second OR circuit (266) being connected to said output ($239_n$) of said comparison circuit ($237_n$) coupled to said adder (236); a third flip-flop (268) having inputs and an output; a reversible binary counter (269) having an input (275), a control input (270), a reset input and outputs (272); said control input (270) of said reversible binary counter (269) being connected to said output of said third flip-flop (268); a memory register (271) having inputs, a reset input and outputs (312); said inputs of said memory register (271) being connected to said outputs (272) of said reversible binary counter (269); the second one of said inputs (273) of said second distributor (257) being connected to the first one of said inputs of said third flip-flop (268), to one of said inputs of said memory register (271) and to the third one of said inputs of said second OR circuit (266); a third OR circuit (274) having inputs and outputs; one of said outputs of said third OR circuit (274) being connected to said input (275) of said reversible binary counter (269);

a first AND circuit (276) having inputs and an output (278); a second AND circuit (277) having inputs and an output (279); said outputs (278, 279) of said first and second AND circuits (276, 277) being connected to respective said outputs (280, 281) of said second flip-flop (260); the second one of said inputs of said first AND circuit (276) being connected to said output (263) of said first pulse generator (262); the second one of said inputs of said second AND circuit (277) being connected to said output (282) of said first flip-flop (259); a fourth flip-flop (283) having inputs and an output (284); said output (284) of said fourth flip-flop (283) being connected to said input of said first pulse generator (262); a second delay element (285) having an input (288) and an output (286); said output (286) of said second delay element (285) being connected to the first one of said inputs of said fourth flip-flop (283); a fourth OR circuit (287) having inputs and an output; said output of said fourth OR circuit (287) being connected to said input (288) of said second delay element (285); one of said inputs of said fourth OR circuit (287) being connected to the second one of said outputs (273) of said second distributor (257); a third AND circuit (289) having inputs and an output; a fourth AND circuit (290) having inputs and an output; said outputs of said third and fourth AND circuits (289, 290) being connected to said inputs (291) of said fourth OR circuit (287); the first one of said inputs (292) of said third AND circuit (289) being connected to the first one of said outputs of said first distributor (255); each of the remaining ones of said inputs of said third AND circuit (289) being connected to said output of a respective said judge's panel (1); the first one of said inputs (293) of said fourth AND circuit (290) being connected to the third one of said outputs of said first distributor (255); the second and third ones of said inputs of said fourth AND circuit (290) being connected to said outputs of respective said on-line judges' panels (40); a fifth OR circuit (294) having inputs and an output (295); one of said inputs of said fifth OR circuit (294) being connected to said output (265) of said first delay element (264); said output (295) of said fifth OR circuit (294) being connected to the second ones of said inputs of said second and fourth flip-flops (260, 283), to said reset inputs of said binary counter (235) and said second distributor (257); a first gate unit ($296_1$) having a group of inputs ($299_1, \ldots, 299_n$), a control input (298) and a group of outputs ($300_1, \ldots, 300_n$); said group of inputs ($299_1, \ldots, 299_n$) of said first gate unit ($296_1$) being connected to respective said outputs (272) of said reversible binary counter (269); a group of OR circuits (301) having inputs and outputs; the first ones of said inputs of said group of OR circuits (301) being connected to said group of outputs ($300_1, \ldots, 300_n$) of said first gate unit ($296_1$); a second gate unit ($296_2$) having inputs ($299_1, \ldots, 299_n$), a control input (298) and outputs ($300_1, \ldots, 300_n$); said inputs ($299_1, \ldots, 299_n$) of said second gate unit ($296_2$) being connected to said outputs of said memory register (177) for storing the final score from said scorer's panel (9); said outputs ($300_1, \ldots, 300_n$) of said second gate unit ($296_2$) being connected to the second ones of said inputs of said group of OR circuits (301); a fifth flip-flop (302) having inputs and outputs; said outputs of said fifth flip-flop (302) being connected to, respectively, said control inputs (298) of said first and second gate units ($296_1$, $296_2$); the first one of said inputs of said fifth flip-flop (302) being connected to said output ($239_n$) of said comparison circuit ($237_n$) coupled to said adder (236) and to one of said outputs ($17_1$) of said processor (12); a programming unit (303) having outputs; a coder (305) having inputs (306) and outputs (310); said inputs (306) of said coder (305) being connected to said outputs of said programming unit (303); a second pulse generator (307) having an output; a fifth AND circuit (308) having inputs and an output; one of said inputs (309) of said fifth AND circuit (308) being connected to said output of said second pulse generator (307); said output of said fifth AND circuit (308) being connected to said inputs of said judges' panels (1) and on-line judges' panels (40); third gate units ($296_{3-1}, \ldots, 296_{3-i}$) having inputs ($299_1, \ldots, 299_n$), control inputs (298) and outputs ($300_1, \ldots, 300_n$); said inputs ($299_1, \ldots, 299_n$) of said third gate units ($296_{3-1}, \ldots, 296_{3-i}$) being connected to said outputs of respective said judges' panels (1); said control inputs (298) of said third gate units ($296_{3-1}, \ldots, 296_{3-i}$) being connected to the other one of said inputs of said fifth AND circuit (308) and to a respective one of said outputs of said superior judge's panel (2);

said outputs ($300_1, \ldots, 300_n$) of said first gate unit ($296_1$), said outputs (312) of said memory register (271) and said outputs ($300_1, \ldots, 300_n$) of said third gate units ($296_{3-1}, \ldots, 296_{3-i}$) being connected to respective said inputs of said third group of inputs (168) of said digital display unit (165) of said superior judge's panel (2); a fourth gate unit ($296_4$) having inputs ($299_1, \ldots, 299_n$), a control input (298) and outputs ($300_1, \ldots, 300_n$); said inputs ($299_1, \ldots, 299_n$) of said fourth gate unit ($296_4$) being connected to said outputs of said superior judge's panel (2); a fifth gate unit ($296_5$) having inputs ($299_1, \ldots, 299_n$), a control input (298) and outputs ($300_1, \ldots, 300_n$); said inputs ($299_1, \ldots, 299_n$) of said fifth unit ($296_5$) being connected to said outputs of said scorer's panel (9); a sixth gate unit ($296_6$) having inputs ($299_1, \ldots, 299_n$), a control input (298) and outputs ($300_1, \ldots, 300_n$); said inputs ($299_1, \ldots, 299_n$) of said sixth gate unit ($296_6$) being connected to said outputs (310) of said coder (305); seventh gate units ($296_{7-1}, \ldots, 296_{7-i}$) having inputs ($299_1, \ldots, 299_n$), a control input (298) and outputs ($300_1, \ldots, 300_n$); said inputs ($299_1, \ldots, 299_n$) of said seventh gate units ($296_{7-1}, \ldots, 296_{7-i}$) being connected to said outputs of said judges' panels (1); an eighth gate unit ($296_8$) having inputs ($299_1, \ldots, 299_n$), a control input (298) and outputs ($300_1, \ldots, 300_n$); said inputs ($299_1, \ldots, 299_n$) of said eighth gate unit ($296_8$) being connected to said outputs of said stop watch (4); a ninth gate unit ($296_9$) having inputs ($299_1, \ldots, 299_n$), a control input (298) and outputs ($300_1, \ldots, 300_n$); said inputs ($299_1, \ldots, 299_n$) of said ninth gate unit ($296_9$) being connected to said outputs (311) of said adder (236); a tenth gate unit ($296_{10}$) having inputs ($299_1, \ldots, 299_n$), a control input (298) and outputs ($300_1, \ldots, 300_n$); said inputs ($299_1, \ldots, 299_n$) of said tenth gate unit ($296_{10}$) being connected to said outputs (312) of said memory register (271); an eleventh gate unit ($296_{11}$) having inputs ($299_1, \ldots, 299_n$), a control input (298) and outputs ($300_1, \ldots, 300_n$); said inputs ($299_1, \ldots, 299_n$) of said eleventh gate unit ($296_{11}$) being connected to said outputs ($313_1, \ldots, 313_n$) of said group of OR circuits (301); a third distributor (314) having an input, a reset input and outputs; said outputs of said third distributor (314) being connected, respectively, to said control inputs (298) of said fourth, fifth, sixth, seventh, eighth, ninth, tenth and eleventh gate units ($296_4$ to $296_{11}$); a third pulse generator (315) having an input and an output (316); said output (316) of said third pulse generator (315) being connected to said input of said third distributor (314) and to said input of said digital printer (11); a sixth flip-flop (317) having inputs and an output (318); said output (318) of said sixth flip-flop (317) being connected to said input of said third pulse generator (315); a second group of OR circuits (319) having inputs and outputs; said inputs of said second group of OR circuits (319) being connected to respective said outputs ($300_1, \ldots, 300_n$) of said fourth, fifth, sixth, seventh, eighth, ninth, tenth and eleventh gate units ($296_4$ to $296_{11}$); a code converter (320) having inputs (321) and outputs; said inputs (321) of said code converter (320) being connected to said outputs of said second group of OR circuits (319); said outputs of said code converter (320) being connected to said inputs of said digital printer (11); a seventh flip-flop (322) having inputs and an output (331); an eighth flip-flop (323) having inputs and an output (332); the first ones of said inputs of said seventh and eighth flip-flops (322, 323) being connected to respective said outputs of said superior judge' s panel (2); a sixth OR circuit (324) having inputs and an output (325); said output (325) of said sixth OR circuit (324) being connected to the first one of said inputs of said sixth flip-flop (317) and to said input of said interface (5); a ninth flip-flop (326) having inputs and an output (330); the first one of said inputs of said ninth flip-flop (326) being connected to said output (325) of said sixth OR circuit (324); the second one of said inputs (327) of said ninth flip-flop (326) being connected to said input of said interface (5); a sixth AND circuit (328) having inputs and an output (335); a seventh AND circuit (329) having inputs and an output (336); the first ones of said sixth and seventh AND circuits (328, 329) being connected to said output (330) of said ninth flip-flop (326); said outputs (331, 332) of said seventh and eighth flip-flops (322, 323) being connected to said inputs of said sixth OR circuit (324) and to the second ones of said inputs of said sixth and seventh AND circuits (328, 329);

one of said outputs (333) of said third distributor (314) being connected to the second one of said inputs of said sixth and seventh AND circuits (328, 329); a seventh OR circuit (334) having inputs and an output (338); said inputs of said seventh OR circuit (334) being connected to said outputs (335, 336) of said sixth and seventh AND circuits (328, 329); a third delay element (337) having an input and an output (339); said input of said third delay element (337) being connected to said output (338) of said seventh OR circuit (334); said output (339) of said third delay element (337) being connected to the second one of said inputs of said fifth flip-flop (302) and to said reset inputs of said memory register (271), said reversible binary counter (269) and said first distributor (255), as well as to the second one of said inputs of said third flip-flop (268), to the second one of said inputs of said fifth OR circuit (294) and to said inputs of said judges' panels (1) and on-line judges' panels (40); a fourth delay element (340) having an input and an output (341); said input of said fourth delay element (340) being connected to said output (339) of said third delay element (337); said output (341) of said fourth delay element (340) being connected to said reset input of said third distributor (314) and to the second one of said inputs of said seventh and eighth flip-flops (322, 323); a fifth delay element (342) having an input and an output (343); said input of said fifth delay element (342) being connected to said output (336) of said seventh AND circuit (329); said output (343) of said fifth delay element (342) being connected to said inputs of said judges' panels (1), on-line judges' panels (40), superior judge's panel (2) and scorer's panel (9); an eighth OR circuit (344) having inputs and an output; the first one of said inputs of said eight OR circuit (344) being connected to said output of said superior judge's panel (2); the second one of said inputs of said eighth OR circuit (344) being connected to said output of said scorer's panel (9); said output of said eighth OR circuit (344) being connected to said input of said luminous display unit (3).

8. A system as claimed in claim 1, wherein said luminous display unit (3) comprises: a three-face luminous display board (345) for displaying the number of a competitor and his or her final score for the execution of an exercise, said three-face luminous display board (345) having inputs; power switches ($357_1$, $257_2$), each having inputs and an output; a first and a second AND circuits (366, 367), each having inputs and outputs; the first ones of said inputs of said first and second AND circuits (366, 367) being connected to respective said outputs of said scorer's panel (9); the second ones of said inputs of said first and second AND circuits (366, 367) being connected to said inputs of said power switches ($357_1$, $357_2$), respectively, which power switches ($357_1$, $357_2$) are coupled to a power supply (368); said outputs of said power switches ($357_1$, $357_2$) being connected to said inputs of said three-face luminous display board (345); an OR circuit (370) for switching on said three-face luminous display board (345), having inputs and an output (375); a first and a second flip-flops (371, 372) for controlling the display of the number of a competitor and his or her final score on said three-face luminous display board (345), both having inputs and outputs; the first ones of said inputs of said first and second flip-flops (371, 372) being connected to respective said outputs of said scorer's panel (9) and processor (12); the second ones of said inputs of said first and second flip-flops (371, 372) being interconnected and coupled to said scorer's panel (9);

said outputs of said first and second flip-flops (371, 372) being connected to said inputs of said OR circuit (370); said output (375) of said OR circuit (370) being connected to said interconnected second inputs of said first and second AND circuits (366, 367); two gate units (375',375'') for feeding the required information to said three-face luminous display board (345), having inputs, control inputs and outputs; said inputs ($299_1, \ldots, 299_i, \ldots, 299_k, \ldots, 299_n$) of said two gate units (375', 375'') being connected to, respectively, said outputs of said scorer's panel (9) and to said outputs of said processor (12); said control input (298) of said first gate unit (375') being connected to said output (373) of said first flip-flop (371); said control input (298) of said second gate unit (375'') being connected to said output (374) of said second flip-flop (372); code converters ($376_1, \ldots, 376_n$) for converting the information code into the code of said three-face luminous display board (345), having inputs and outputs; said outputs of said code converters ($376_1, \ldots, 376_n$) being connected to respective said inputs of said threeface luminous display board (345); group of OR circuits ($377_1, \ldots, 377_n$) having inputs and outputs ($378_1, \ldots, 378_n$); said outputs ($378_1, \ldots, 378_n$) of said groups of OR circuits ($377_1, \ldots, 377_n$) being connected to said inputs of respective said code converters ($376_1, \ldots, 376_n$); the first ones of said inputs of said groups of OR circuits ($377_1, \ldots, 377_n$) being connected to respective said outputs of said first gate units (375'); the second ones of said inputs of said groups of OR circuits ($377_1, \ldots, 377_n$) being connected to respective said outputs of said second gate unit (375'').

* * * * *